US009616666B2

(12) United States Patent
Yoshioka et al.

(10) Patent No.: US 9,616,666 B2
(45) Date of Patent: Apr. 11, 2017

(54) METHOD OF MANUFACTURING ELEMENT SUBSTRATE

(71) Applicant: CANON KABUSHIKI KAISHA, Tokyo (JP)

(72) Inventors: Toshifumi Yoshioka, Hiratsuka (JP); Toru Nakakubo, Kawasaki (JP); Shinichiro Watanabe, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/820,823

(22) Filed: Aug. 7, 2015

(65) Prior Publication Data

US 2016/0059562 A1 Mar. 3, 2016

(30) Foreign Application Priority Data

Aug. 29, 2014 (JP) ..... 2014-175518

(51) Int. Cl.
*B41J 2/16* (2006.01)
*B41J 2/14* (2006.01)

(52) U.S. Cl.
CPC ..... *B41J 2/161* (2013.01); *B41J 2/14233* (2013.01); *B41J 2/1628* (2013.01); *B41J 2/1629* (2013.01); *B41J 2/1631* (2013.01)

(58) Field of Classification Search
CPC ..... B41J 2/161; B41J 2/1629; B41J 2/14233; B41J 2/1628; B41J 2/1631; B25J 19/028;
(Continued)

(56) References Cited

U.S. PATENT DOCUMENTS 6,382,777 B1 5/2002 Yamaguchi et al.
8,820,895 B2 9/2014 Bibl et al.
(Continued)

FOREIGN PATENT DOCUMENTS

CN 102481789 A 5/2012
JP 2007-165651 A 6/2007
(Continued)

OTHER PUBLICATIONS

Notification of First Office Action in Chinese Application No. 201510535655.3 (Aug. 10, 2016).
(Continued)

*Primary Examiner* — Julio J Maldonado
*Assistant Examiner* — Stanetta Issac
(74) *Attorney, Agent, or Firm* — Fitzpatrick, Cella, Harper & Scinto

(57) ABSTRACT

Provided is a method of manufacturing an element substrate, including: forming first and second resists on a predetermined surface of a substrate so that part of the predetermined surface is exposed; etching the substrate with the first and second resists being used as a mask to form a first recess in the substrate; removing the second resist to expose a portion of the substrate that is different from the first recess; etching the substrate with the first resist being used as a mask to deepen the first recess and to form a second recess communicating with the first recess in the substrate; and covering openings of the first and second recesses with an orifice forming member to form a pressure chamber by the first recess and an orifice forming member and to form a flow reducing portion by the second recess and the orifice forming member.

12 Claims, 27 Drawing Sheets

(58) Field of Classification Search
CPC ..... G01L 9/0022; G01L 9/008; H01L 41/00; H01L 41/04; H01L 41/042; H01L 2224/79347; H01L 2224/78347; H01L 2224/77347; H01L 2224/76
See application file for complete search history.

(56) References Cited

U.S. PATENT DOCUMENTS

| | | | | |
|---|---|---|---|---|
| 8,857,953 | B2 | 10/2014 | Suzuki et al. | |
| 9,278,368 | B2 | 3/2016 | Bibl et al. | |
| 2006/0261034 | A1 | 11/2006 | Kurashima et al. | |
| 2012/0028383 | A1* | 2/2012 | Hiramoto ..... | B41J 2/1603 438/21 |
| 2014/0239089 | A1 | 8/2014 | Bibl et al. | |
| 2016/0185114 | A1 | 6/2016 | Bibl et al. | |

FOREIGN PATENT DOCUMENTS

| | | | |
|---|---|---|---|
| JP | 2007-190776 | A | 8/2007 |
| JP | 2008-307768 | A | 12/2008 |
| JP | 2012-532772 | A | 12/2012 |

OTHER PUBLICATIONS

Yoshioka et al., U.S. Appl. No. 14/832,438, filed on Aug. 21, 2015.

* cited by examiner

METHOD OF MANUFACTURING ELEMENT SUBSTRATE

BACKGROUND OF THE INVENTION

Field of the Invention

The present invention relates to a method of manufacturing an element substrate for ejecting liquid.

Description of the Related Art

A liquid ejection device for ejecting liquid such as ink to record an image on a recording medium generally has a liquid ejection head mounted thereon that includes an element substrate.

As a mechanism for ejecting liquid from the element substrate, one using a pressure chamber that contracts through the action of a piezoelectric element is known. In an element substrate having such a mechanism, a wall of the pressure chamber is a diaphragm. Through application of a voltage to the piezoelectric element leading to deformation of the piezoelectric element, the diaphragm warps, and the pressure chamber contracts and expands. The contraction of the pressure chamber applies a pressure to liquid in the pressure chamber, and the liquid is ejected through an orifice communicating with the pressure chamber.

A supply path is formed in the element substrate, and the liquid is supplied from the supply path to the pressure chamber. The supply path has a cross section perpendicular to a flow direction of the liquid (hereinafter referred to as "flow path cross section") that is smaller than a flow path cross section of the pressure chamber, and functions as a flow reducing portion. It is known that usage of the supply path as a flow reducing portion maintains a certain level of a flow path resistance of liquid that flows into the pressure chamber to stabilize ejection characteristics of the element substrate.

In recent years, a liquid ejection device that can render an image at a high speed is required. In order to render an image at a high speed, it is necessary to shorten an ejection cycle of each pressure chamber. It is proposed that, as the ejection cycle is shortened, a volume of the liquid related to the ejection, that is, a capacity of the pressure chamber, is reduced to reduce a compliance of the liquid. The reduction in compliance increases a natural frequency of the pressure chamber, and thus, even if the ejection cycle is shortened, the liquid can be ejected with efficiency.

Further, a structure is known in which the flow path cross section of the flow reducing portion is further reduced along with downsizing of the pressure chamber (Japanese Patent Application Laid-Open No. 2012-532772). In an element substrate disclosed in Japanese Patent Application Laid-Open No. 2012-532772, a flow reducing portion and a pressure chamber are formed between a diaphragm and an orifice forming member. Reducing a distance between the diaphragm and the orifice forming member reduces the flow path cross section of the flow reducing portion and the capacity of the pressure chamber. Therefore, a frequency response of the pressure chamber can be improved without loss of stability of the ejection characteristics of the element substrate.

According to a technology disclosed in Japanese Patent Application Laid-Open No. 2012-532772, the pressure chamber and a flow inlet and a flow outlet that function as a flow reducing portion are formed by filling holes formed in a silicon layer on the diaphragm with the orifice forming member. A groove corresponding to the pressure chamber and a groove corresponding to the flow reducing portion are simultaneously formed by etching the silicon layer from a side opposite to the diaphragm. Therefore, a depth of the groove corresponding to the flow reducing portion is the same as a depth of the groove corresponding to the pressure chamber. In order to secure a flow path resistance of the flow reducing portion, a width of the groove corresponding to the flow reducing portion (that means a dimension of the groove in a direction perpendicular to the flow direction of the liquid and to a depth direction of the groove, and the same holds true hereinafter) is required to be smaller than a width of the groove corresponding to the pressure chamber.

It is relatively difficult to form a groove having a small width and a large depth, and the width of the groove tends to vary. Variations in the width of the groove lead to variations in the flow path resistance of the flow reducing portion, which affects desired ejection characteristics. From those reasons, a manufacturing method disclosed in Japanese Patent Application Laid-Open No. 2012-532772 requires processing of the silicon layer with higher accuracy, and thus, there is a problem of a low yield.

SUMMARY OF THE INVENTION

It is an object of the present invention to provide a method of manufacturing an element substrate that can render an image at a high speed with a high yield.

In order to achieve the object described above, the present invention is directed to providing a method of manufacturing an element substrate, the element substrate including: an orifice forming member having an orifice for ejecting liquid formed therein; and a flow path forming member for forming a pressure chamber for storing the liquid to be ejected through the orifice and for generating an ejection pressure, and forming a flow reducing portion communicating with the pressure chamber, the method including: forming a first resist and a second resist on a predetermined surface of a substrate serving as the flow path forming member so that part of the predetermined surface is exposed; etching the substrate with the first resist and the second resist being used as a mask to form a first recess in the substrate; removing the second resist to expose a portion of the substrate that is different from the first recess; etching the substrate with the first resist being used as a mask to deepen the first recess and to form a second recess communicating with the first recess in the substrate; and covering openings of the first recess and the second recess with the orifice forming member to form the pressure chamber by the first recess and the orifice forming member and to form the flow reducing portion by the second recess and the orifice forming member.

According to the present invention, after the substrate is etched with the first and second resists being used as a mask, the second resist is removed, and the substrate is further etched with only the first resist being used as a mask, and thus, the first recess and the second recess that is shallower than the first recess may be formed in the same substrate. The first recess serves as the pressure chamber and the second recess serves as the flow reducing portion, and thus, a flow path width of the flow reducing portion may be increased, and variations in the flow path width of the flow reducing portion may be inhibited. As a result, the element substrate with stable ejection characteristics may be manufactured with simple processing.

Further features of the present invention will become apparent from the following description of exemplary embodiments with reference to the attached drawings.

DESCRIPTION OF THE EMBODIMENTS

Figure 1A:
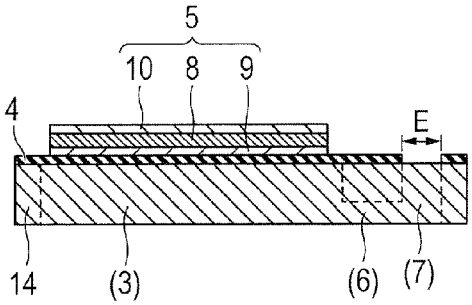
FIGS. 1A, 1B, 1C, 1D, 1E, 1F and 1G are illustrations of a method of manufacturing an element substrate according to a first embodiment of the present invention.

Embodiments for carrying out the present invention are described in the following with reference to the attached drawings.

First Embodiment

FIGS. 1A to 1G are illustrations of a method of manufacturing an element substrate according to the present invention. In particular, steps that are closely related to the present invention are illustrated in side sectional views (sectional side elevations or vertical sections). FIG. 2A is a side sectional view for illustrating the element substrate that is manufactured using the present invention. FIG. 2B is a sectional view for illustrating the element substrate taken along the line x-x' of FIG. 2A.

As illustrated in FIGS. 2A and 2B, an element substrate 1 includes an orifice 2 for ejecting liquid and a pressure chamber 3 for storing the liquid ejected through the orifice 2 and for applying an ejection pressure to the liquid. One of walls of the pressure chamber 3 is formed of a diaphragm 4. An actuating portion 5 is joined to the diaphragm 4. Actuation of the actuating portion 5 deforms the diaphragm 4 to apply a pressure to the liquid in the pressure chamber 3.

The element substrate 1 further includes a flow reducing portion 6 that communicates with the pressure chamber 3 and a communicating hole 7 that extends from the flow reducing portion 6 to a common liquid chamber (not shown). The liquid is supplied from the common liquid chamber to the pressure chamber 3 via the communicating hole 7 and the flow reducing portion 6.

The flow reducing portion 6 is shallower than the pressure chamber 3 (a depth A of the flow reducing portion 6 is smaller than a depth B of the pressure chamber 3), and a flow path cross section of the flow reducing portion 6 is smaller than a flow path cross section of the pressure chamber 3. Therefore, the flow reducing portion 6 functions to maintain a certain level of a flow path resistance of the liquid that flows from the flow reducing portion 6 into the pressure chamber 3. The liquid in the flow reducing portion 6 has a relatively large inertia, and thus, when a pressure is applied to the liquid in the pressure chamber 3, much of the liquid flows toward the orifice 2.

It is more preferred that the flow reducing portion 6 have a smaller width than that of the pressure chamber 3 (a flow path width C of the flow reducing portion be smaller than a flow path width D of the pressure chamber 3). The flow path cross section of the flow reducing portion 6 can be smaller than the flow path cross section of the pressure chamber 3 to further improve the function of the flow reducing portion 6.

Note that, the depth B and the flow path width C of the flow reducing portion 6 are appropriately set depending on an area of the flow path cross section of the pressure chamber 3, a volume of the pressure chamber 3, characteristics of the actuating portion, specifications of the orifice 2, a viscosity of the liquid to be ejected, an ejection frequency, a processing accuracy, and the like.

The actuating portion 5 includes a piezoelectric element 8, and a first electrode 9 and a second electrode 10 opposed to each other with the piezoelectric element 8 sandwiched therebetween. The first electrode 9 is joined to the diaphragm 4. The first electrode 9 is, for example, a common electrode, and the second electrode 10 is, for example, an individual electrode. The first electrode 9 and the second electrode 10 are connected to wiring (not shown), and the wiring is led out to a control circuit outside the element substrate 1.

When the element substrate 1 is actuated, an electrical signal is transmitted from the control circuit to the first electrode 9 and the second electrode 10 via the wiring (not shown). This applies a voltage to the piezoelectric element 8 to deform the piezoelectric element 8. Based on the deformation of the piezoelectric element 8, the diaphragm 4 warps and the pressure chamber 3 contracts and expands. The contraction of the pressure chamber 3 is accompanied with pressure application to the liquid in the pressure chamber 3 to eject the liquid through the orifice 2.

The orifice 2 is a through hole formed in an orifice forming member 11. The orifice forming member 11 is formed so as to be opposed to the diaphragm 4 with space provided therebetween. A flow path forming member 12 is formed between the orifice forming member 11 and the diaphragm 4. The pressure chamber 3 and the flow reducing portion 6 are defined by the diaphragm 4, the flow path forming member 12, and the orifice forming member 11. A member including the flow path forming member 12, the diaphragm 4, the first electrode 9, the piezoelectric element 8, and the second electrode 10 is also referred to as an actuator substrate 13. It is preferred that the orifice forming member 11 and the actuator substrate 13 be stacked so that the orifice 2 and the actuating portion 5 are opposed to each other.

Note that, in an example illustrated in FIGS. 2A and 2B, the pressure chamber 3 is substantially in a rectangular shape in plan view, but the shape of the pressure chamber 3 in plan view is not limited thereto, and various shapes are possible. The pressure chamber 3 may be in a substantial parallelogram, a substantial trapezoid, a substantial ellipsoid, or a substantial oval.

Next, a method of manufacturing the element substrate according to the present invention is described with reference to FIGS. 1A to 1G. In FIGS. 1A to 1G, for the sake of easy understanding, regions serving as the pressure chamber 3, the flow reducing portion 6, and the communicating hole 7 are shown by the broken lines.

Figure 2A:
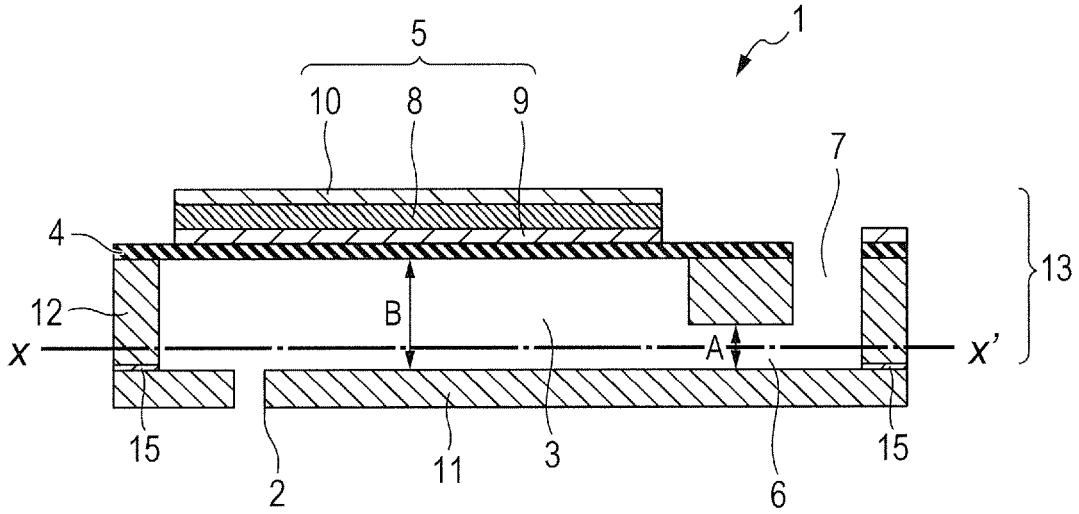
FIGS. 2A and 2B are sectional views of the element substrate manufactured according to the first embodiment.
Figure 2B:
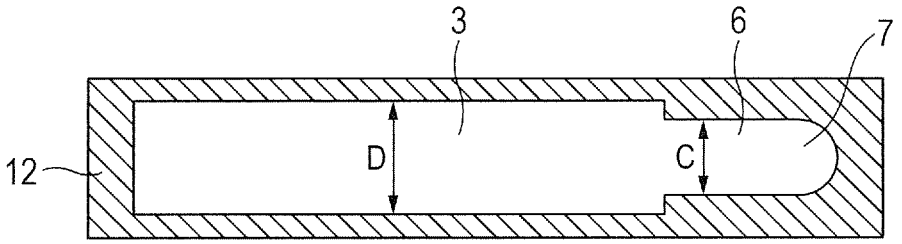

First, as illustrated in FIG. 1A, the diaphragm 4, the first electrode 9, the piezoelectric element 8, and the second electrode 10 that serve as a drive layer are formed on a substrate 14 that is a silicon monocrystalline substrate. The substrate 14 is a member serving as the flow path forming member 12 (see FIGS. 2A and 2B). Here, it is preferred that the diaphragm 4 and the first electrode 9 be open in a region E opposed to the communicating hole 7 to be formed in a subsequent step.

Figure 1B:
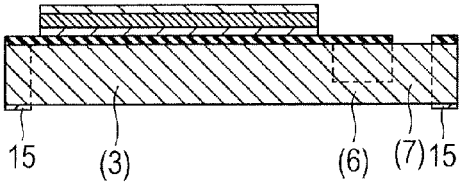

Then, as illustrated in FIG. 1B, a first resist 15 is formed on a predetermined surface of the substrate 14 using photolithography. At this time, the first resist 15 is formed so that a portion of the substrate 14 that corresponds to the pressure chamber 3, the flow reducing portion 6, and the communicating hole 7 is exposed.

As the first resist 15, a thin film (organic photosensitive resin film) such as an ordinary photoresist or a photosensitive dry film can be used. Alternatively, as the first resist 15, a metal film of Cr, Al, or the like, or an inorganic oxide film or a nitride film of $SiO_2$, SiN, TaN, or the like can be used.

Figure 1C:
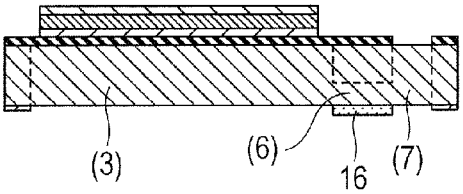

Then, as illustrated in FIG. 1C, a second resist 16 is formed using the photolithography. At this time, the second resist 16 is formed so that a portion of the substrate 14 that corresponds to the pressure chamber 3 and the communicating hole 7 is exposed. In other words, the second resist 16 covers a portion of the substrate 14 that corresponds to the flow reducing portion 6.

As the second resist 16, similarity to the first resist 15, a thin film (organic photosensitive resin film) such as an ordinary photoresist or a photosensitive dry film can be used. Alternatively, as the second resist 16, a metal film of Cr, Al, or the like, or an inorganic oxide film or a nitride film of $SiO_2$, SiN, TaN, or the like can be used.

It is preferred that a material of the second resist 16 be determined taking into consideration the first resist 15 that is already formed. Specifically, it is preferred that at least one of the first and second resists be an inorganic thin film and another of the first and second resists be an organic thin film.

In this embodiment, $SiO_2$ (inorganic thin film) is used as the first resist 15, and, taking into consideration the first resist 15 that is already formed, a positive photoresist (organic thin film) is used as the second resist 16.

Figure 1D:
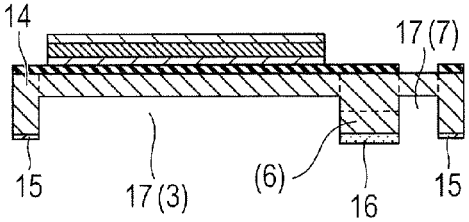

Then, as illustrated in FIG. 1D, the substrate 14 is etched with the first resist 15 and the second resist 16 being used as a mask to form a first recess 17 (first etching process). The first recess 17 is formed to midway through the substrate 14 so as not to pierce the substrate 14. The formation of the recess in the substrate 14 is also referred to as deep-RIE.

Figure 1E:
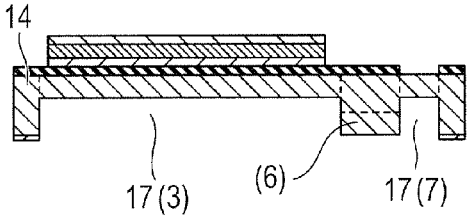

Then, as illustrated in FIG. 1E, the second resist 16 is removed with a remover or the like to expose a portion of the substrate 14 that is different from the first recess 17.

Figure 1F:
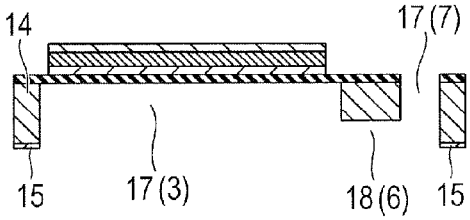

Then, as illustrated in FIG. 1F, the substrate 14 is etched with the remaining first resist 15 being used as a mask to deepen the first recess 17 and to form a second recess 18 in the substrate 14 (second etching process). The first recess 17 reaches the diaphragm 4. In this way, the flow path forming member 12 (see FIGS. 2A and 2B) formed of the substrate 14 is completed.

In this embodiment, dry etching of the substrate 14 is carried out in the first and second etching processes. The dry etching is processing in which, using a plasma reactive ion etching apparatus, etching of Si with a $SF_6$ gas and formation of side wall protection with a $C_4F_8$ gas are repeatedly carried out. Through the dry etching, the first recess 17 and the second recess 18 can be formed with higher accuracy.

Figure 1G:
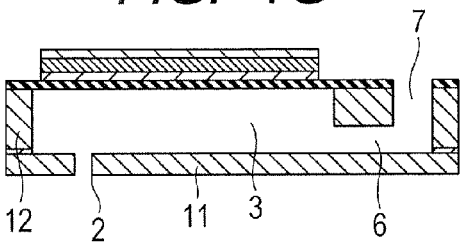

Then, as illustrated in FIG. 1G, the orifice forming member 11 having the orifice 2 formed therein is mounted on the flow path forming member 12 so as to cover an opening of the first recess 17 and an opening of the second recess 18. The pressure chamber 3 and the communicating hole 7 are formed by the first recess 17 and the orifice forming member 11, and the flow reducing portion 6 is formed by the second recess 18 and the orifice forming member 11. It is preferred that the orifice forming member 11 be formed so that the orifice and the actuating portion 5 are opposed to each other.

Note that, in this embodiment, the orifice forming member 11 is mounted on the flow path forming member 12 without removing the first resist 15, but the first resist 15 may be removed.

In the manufacturing method according to this embodiment, the substrate 14 is etched with the first resist 15 and the second resist 16 being used as the mask, and, after the second resist 16 is removed, the substrate 14 is further etched with the first resist 15 being used as the mask. This can cause the depth A of the flow reducing portion 6 to be smaller than the depth B of the pressure chamber 3, and thus, the flow path width C of the flow reducing portion 6 can be larger. Therefore, variations in the flow path width C are less liable to occur, and the flow path resistance of the flow reducing portion 6 can be stabilized. As a result, the element substrate 1 with stable ejection characteristics can be manufactured with simple processing and with a high yield.

When the first recess 17 and the second recess 18 are formed in the substrate 14, the substrate 14 may be wet etched (anisotropic etching), but it is more preferred that the substrate 14 be dry etched. By using deep-RIE of dry etching, side walls of the first recess 17 and the second recess 18 can be formed so as to be approximately perpendicular to the diaphragm 4. This can prevent the side walls of the recesses from being slanted with respect to the diaphragm 4, which occurs in the case of wet etching, and the orifice 2 can be formed with a greater area efficiency.

Note that, in this embodiment, a material of the second resist 16 is different from a material of the first resist 15, and the second resist 16 is formed in a process different from a process of forming the first resist 15, but the present invention is not limited thereto. According to the present invention, the first resist 15 and the second resist 16 may be formed of the same material and may be formed in the same process as one resist. In this case, after the first recess 17 is formed, part of the one resist (a portion corresponding to the second resist 16) may be removed, and then, the substrate 14 may be etched with the remaining resist (a portion corresponding to the first resist 15) being used as a mask.

Further, the present invention is not limited to a method of manufacturing the element substrate 1 for ejecting liquid using a pressure chamber that contracts through action of a piezoelectric element, and may also be applied to a method of manufacturing an element substrate for ejecting liquid using thermal energy generated by a heat generating resistor.

Second Embodiment

Figure 3A:
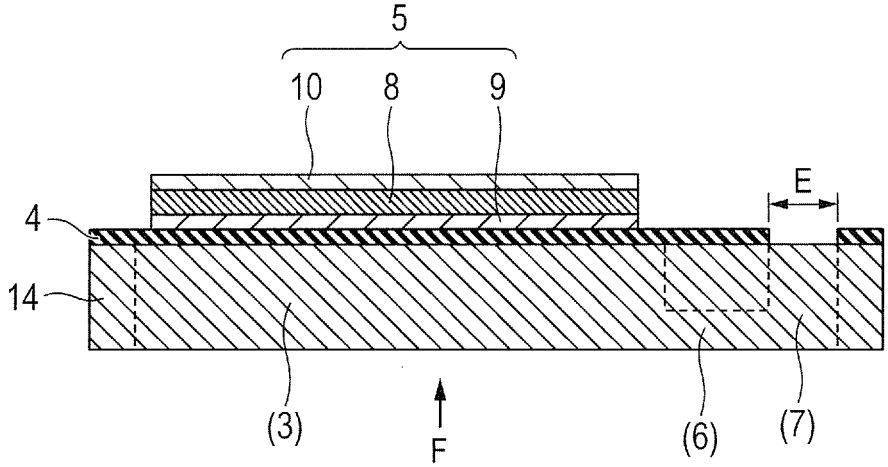
FIGS. 3A and 3B are a sectional view and a plan view, respectively, of a substrate and a drive layer used in a second embodiment of the present invention.
Figure 3B:
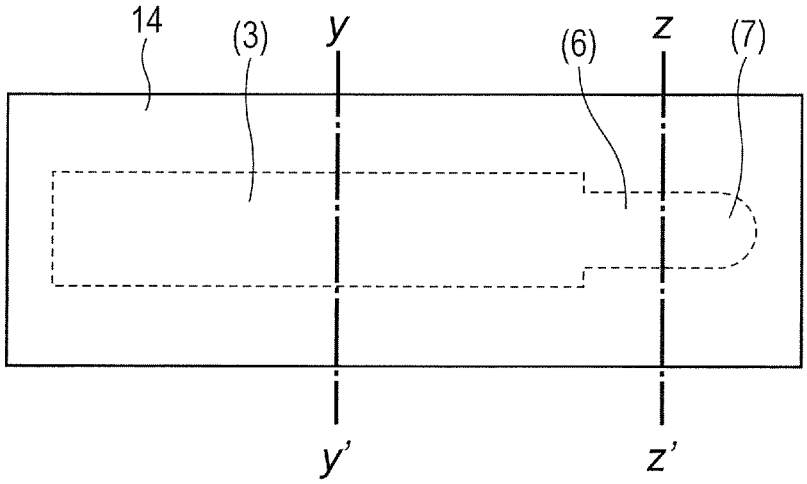
Figure 4A:
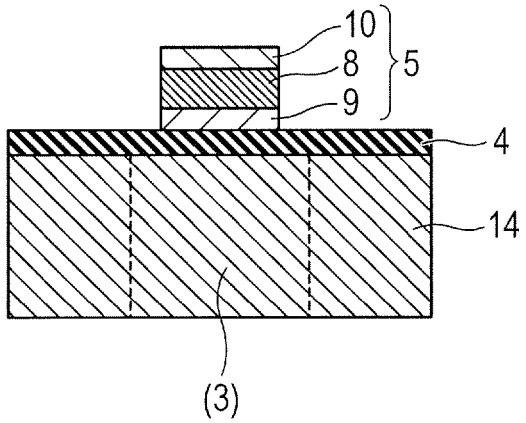
FIGS. 4A and 4B are sectional views of the substrate and the drive layer illustrated in FIGS. 3A and 3B.
Figure 4B:
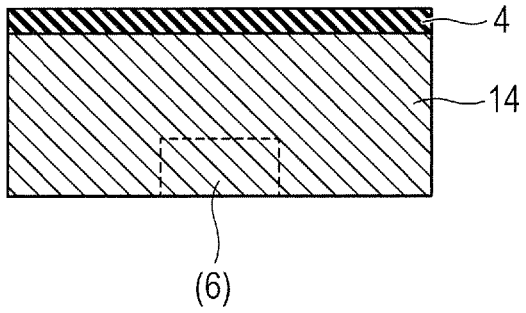

Next, a second embodiment according to the present invention is described with reference to FIG. 3A to FIG. 9B. FIGS. 3A and 3B and FIGS. 4A and 4B are schematic views of the substrate 14 and the drive layer used in the second embodiment. FIG. 3A is a sectional view of the substrate 14 and the drive layer, and FIG. 3B is a plan view of the substrate 14 and the drive layer illustrated in FIG. 3A, when seen from a direction of the arrow F. FIG. 4A is a sectional view for illustrating the substrate 14 and the drive layer taken along the line y-y' of FIG. 3B, and FIG. 4B is a sectional view for illustrating the substrate 14 and the drive layer taken along the line z-z' of FIG. 3B.

Note that, in FIGS. 3A and 3B and FIGS. 4A and 4B, for the sake of easy understanding, the region serving as the pressure chamber 3, the flow reducing portion 6, and the communicating hole 7 of the element substrate 1 (see FIGS. 2A and 2B) is shown by the broken lines.

As illustrated in FIG. 3A and FIGS. 4A and 4B, the diaphragm 4, the first electrode 9, the piezoelectric element 8, and the second electrode 10 that serve as the drive layer are formed on the substrate 14 that is a silicon monocrystalline substrate. The diaphragm 4 and the first electrode 9 are open in the region E to be opposed to the communicating hole 7 in a subsequent step.

A manufacturing method according to the second embodiment is described in detail with reference to FIG. 5A to FIG. 9B. FIG. 5A to FIG. 9B are sectional views for illustrating this embodiment, and the sectional views correspond to the sectional views of FIGS. 4A and 4B, respectively.

Figure 5A:
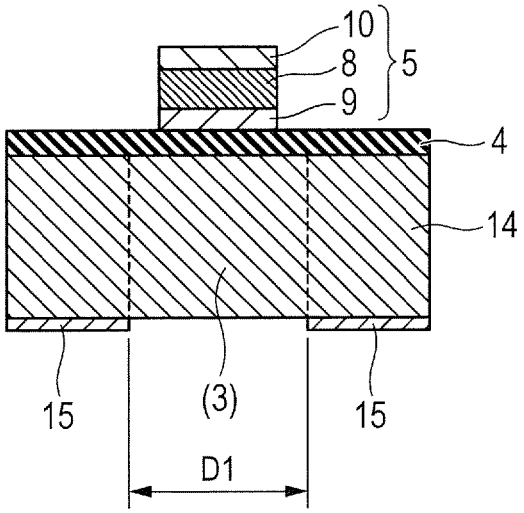
FIGS. 5A and 5B are sectional views for illustrating the second embodiment.
Figure 5B:
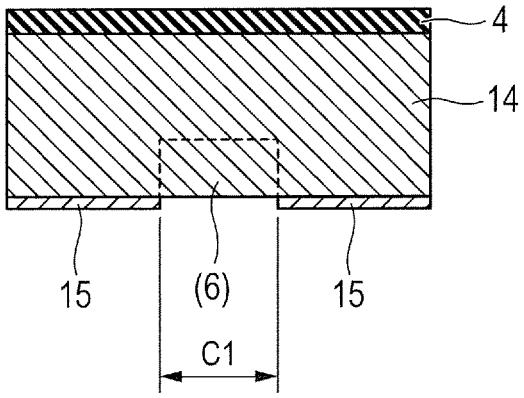

First, as illustrated in FIGS. 5A and 5B, the first resist 15 is formed on the surface of the substrate on the side opposite to the surface on which the diaphragm 4 is formed, using the photolithography. At this time, an opening is formed in the first resist 15. A width D1 of the opening corresponds to the flow path width D of the pressure chamber 3 (see FIG. 2B), and a width C1 of the opening corresponds to the flow path width C of the flow reducing portion 6 (see FIG. 2B). As the first resist 15, similarly to the case of the first embodiment, $SiO_2$ is used.

Figure 6A:
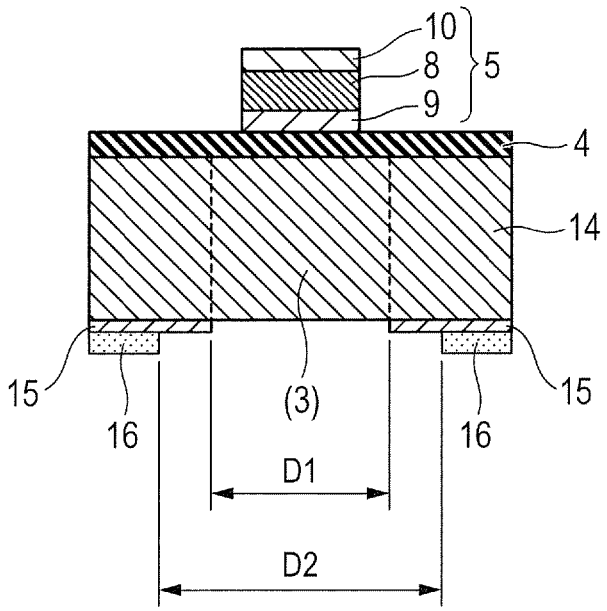
FIGS. 6A and 6B are sectional views for illustrating the second embodiment.
Figure 6B:
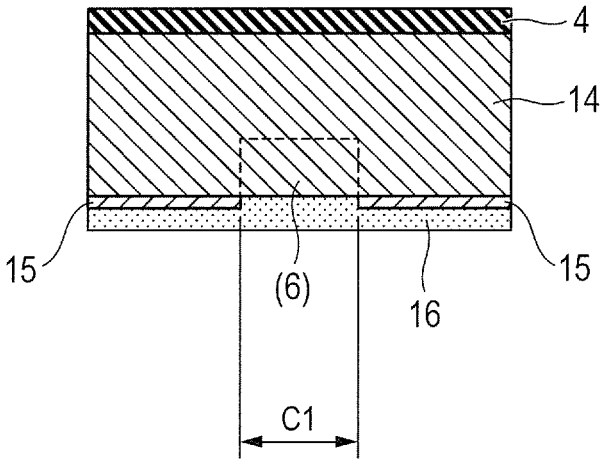

Then, as illustrated in FIGS. 6A and 6B, the second resist 16 is formed on the substrate 14 and on the first resist 15 using the photolithography. As the second resist 16, similarly to the case of the first embodiment, a positive photoresist is used. An opening is formed in the second resist 16 so that a portion of the opening in the first resist 15 having the width D1 is exposed and a portion of the opening in the first resist 15 having the width C1 is covered with the second resist 16. A width D2 of the opening in the second resist 16 is larger than the width D1 of the opening formed in the first resist 15.

Figure 7A:
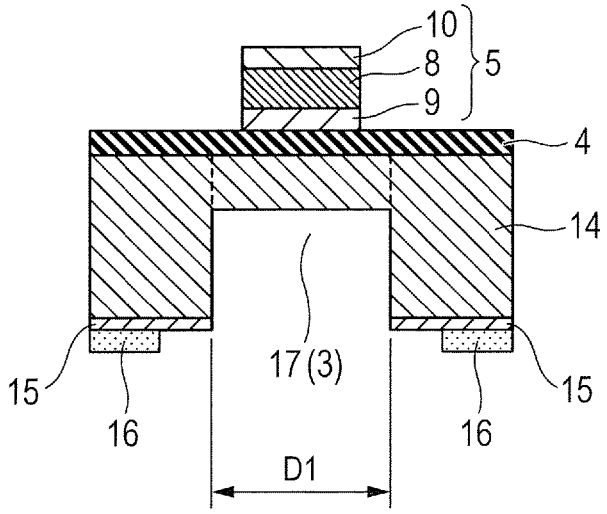
FIGS. 7A and 7B are sectional views for illustrating the second embodiment.
Figure 7B:
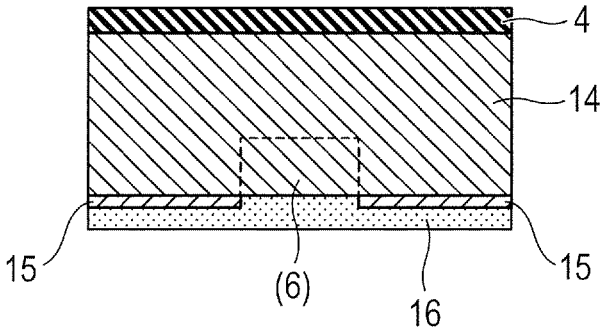

Then, as illustrated in FIGS. 7A and 7B, the substrate 14 is dry etched with the first resist 15 and the second resist 16 being used as the mask to form the first recess 17 (first etching process). The first recess 17 is formed to midway through the substrate 14 so as not to pierce the substrate 14.

In a portion of the substrate 14 corresponding to the pressure chamber 3, the etching progresses along the opening in the first resist 15, and the first recess 17 is to have the width D1. A portion of the substrate 14 corresponding to the flow reducing portion 6 is covered with the second resist 16, and thus, the etching does not progress in the portion.

Figure 8A:
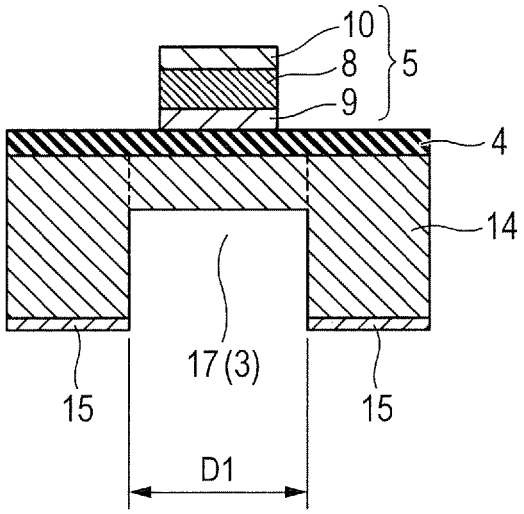
FIGS. 8A and 8B are sectional views for illustrating the second embodiment.
Figure 8B:
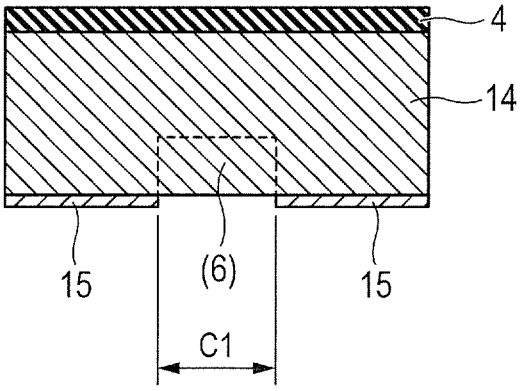

Then, as illustrated in FIGS. 8A and 8B, the second resist 16 is removed with a remover or the like to expose a portion of the substrate 14 that is different from the first recess 17.

Figure 9A:
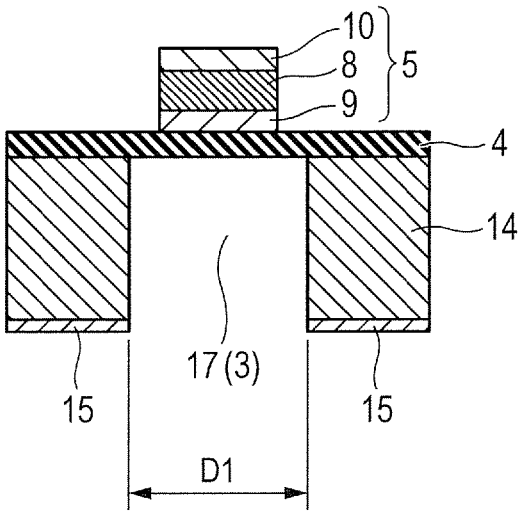
FIGS. 9A and 9B are sectional views for illustrating the second embodiment.
Figure 9B:
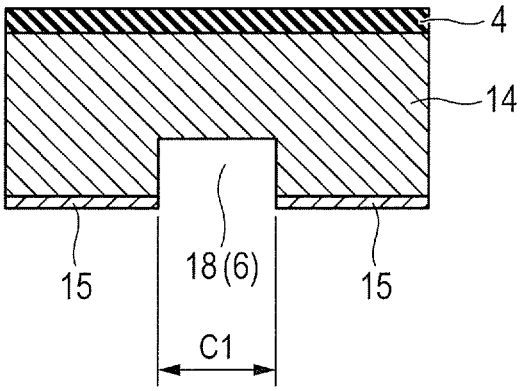

Then, as illustrated in FIGS. 9A and 9B, the substrate 14 is dry etched with the remaining first resist 15 being used as a mask to deepen the first recess 17 and to form the second recess 18 (second etching process). In the portion of the substrate 14 corresponding to the pressure chamber 3, the etching progresses along the opening in the first resist 15, and the first recess 17 becomes deeper with the width D1 being maintained. Also in the portion of the substrate 14 corresponding to the flow reducing portion 6, the etching progresses along the opening in the first resist 15, and the second recess 18 is to have the width C1. The first recess 17 reaches the diaphragm 4. In this way, the flow path forming member 12 (see FIGS. 2A and 2B) formed of the substrate 14 is completed.

Finally, the orifice forming member 11 having the orifice 2 formed therein (see FIG. 2A) is mounted on the substrate 14 (flow path forming member 12) so as to cover the opening of the first recess 17 and the opening of the second recess 18. The pressure chamber 3 and the communicating hole 7 are formed by the first recess 17 and the orifice forming member 11, and the flow reducing portion 6 is formed by the second recess 18 and the orifice forming member 11. It is preferred that the orifice forming member 11 be formed so that the orifice and the actuating portion 5 are opposed to each other.

Note that, in this embodiment, the orifice forming member 11 is mounted on the flow path forming member 12 without removing the first resist 15, but the first resist 15 may be removed.

When the element substrate 1 is actuated, as described above, the piezoelectric element 8 is deformed with an electrical signal to deform the diaphragm 4. As a result, the pressure chamber 3 contracts and expands to generate and apply a pressure to the liquid in the pressure chamber 3.

The ejection characteristics of the element substrate 1 are affected by a vibrating region of the diaphragm 4. The vibrating region of the diaphragm 4 depends on a size of a portion of the diaphragm 4 that forms a wall of the pressure chamber 3 (hereinafter referred to as "wall portion"). In particular, when the wall portion of the diaphragm 4 is in a shape having a longitudinal axis (for example, a substantial rectangle, a substantial parallelogram, a substantial trapezoid, a substantial ellipsoid, or a substantial oval), the vibrating region of the diaphragm 4 is dominated by a dimension of a minor axis of the wall portion of the diaphragm 4. Further, variations in the flow path width of the flow reducing portion 6 lead to variations in the flow path resistance, which affects the ejection characteristics.

In the second embodiment, the dimension of the minor axis of the wall portion of the diaphragm 4 and the flow path width of the flow reducing portion 6 that greatly affect the ejection characteristics of the element substrate 1 are determined by the opening in the one resist (first resist 15) through the first and second etching processes. Therefore, variations in the dimension of the minor axis of the wall portion of the diaphragm 4 and in the flow path width of the flow reducing portion 6 are inhibited, and variations in the ejection characteristics can be further reduced.

Third Embodiment

Figure 10A:
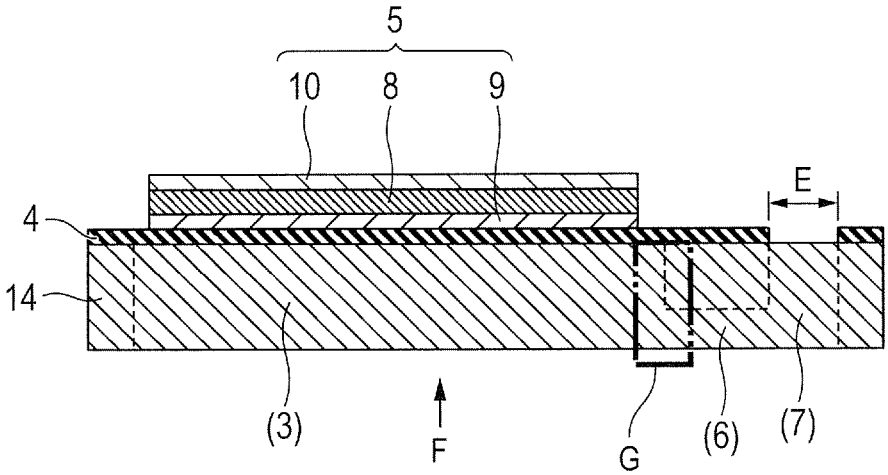
FIGS. 10A and 10B are a sectional view and a plan view, respectively, of a substrate and a drive layer used in a third embodiment of the present invention.
Figure 10B:
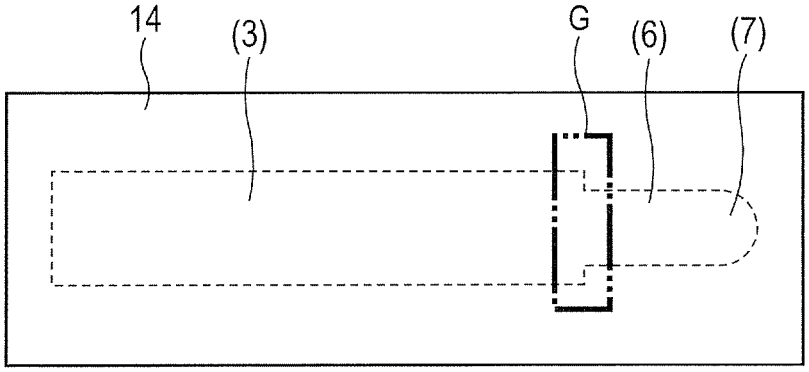

Next, a third embodiment according to the present invention is described with reference to FIG. 10A to FIG. 15B. FIGS. 10A and 10B and FIGS. 11A and 11B are schematic views of the substrate 14 and the drive layer used in the third embodiment. FIG. 10A is a sectional view of the substrate 14 and the drive layer, and FIG. 10B is a plan view of the substrate 14 illustrated in FIG. 10A when seen from a direction of the arrow F.

Note that, in FIGS. 10A and 10B, for the sake of easy understanding, the region serving as the pressure chamber 3, the flow reducing portion 6, and the communicating hole 7 of the element substrate 1 (see FIGS. 2A and 2B) is shown by the broken lines.

As illustrated in FIG. 10A, the diaphragm 4, the first electrode 9, the piezoelectric element 8, and the second electrode 10 that serve as the drive layer are formed on the substrate 14 that is a silicon monocrystalline substrate. The diaphragm 4 and the first electrode 9 are open in the region E to be opposed to the communicating hole 7 in a subsequent step.

Figure 11A:
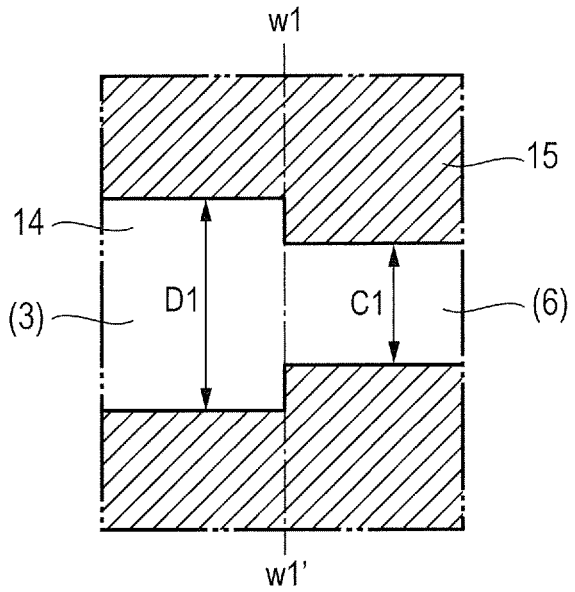
FIGS. 11A and 11B are illustrations of first and second resists in the third embodiment.
Figure 11B:
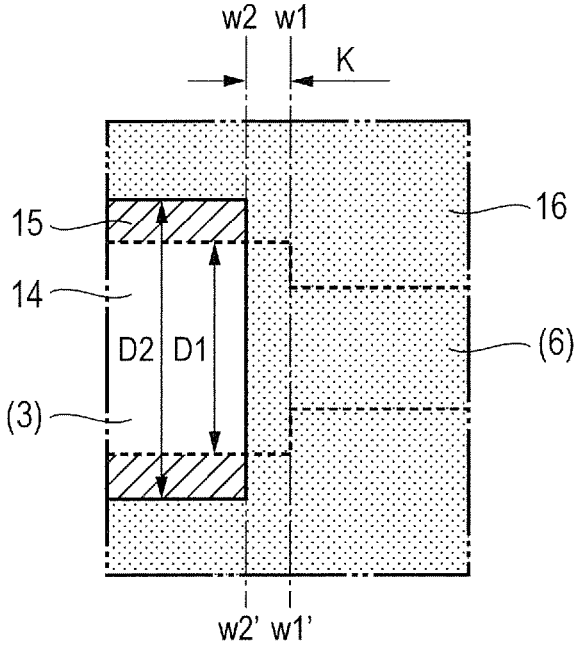

FIGS. 11A and 11B are illustrations of the first resist 15 and the second resist 16 in the third embodiment, and FIG. 11A is a plan view of a portion corresponding to a communicating portion between the pressure chamber 3 and the flow reducing portion 6 (hereinafter referred to as "communicating portion G" (see FIGS. 10A and 10B)) when seen from the direction of the arrow F in FIG. 10A.

Note that, the first resist 15 and the second resist 16 are hatched. In FIG. 11A, the first resist 15 is illustrated. In FIG. 11B, the first resist 15 and the second resist 16 are illustrated. With reference to FIG. 11B, part of the first resist 15 is covered with the second resist 16. In FIG. 11B, for the sake of easy understanding of a positional relationship between the first resist 15 and the second resist 16, edges of the first resist 15 are shown by the broken lines.

As illustrated in FIG. 11A, the first resist 15 has an opening formed therein, and a width of the opening changes at an exposed width change portion w1-w1'. More specifically, the opening is divided by the exposed width change portion w1-w1' into a first opening portion and a second opening portion. The first opening portion has the width D1 and the second opening portion has the width C1 that is smaller than the width D1.

As illustrated in FIG. 11B, the second resist 16 has an opening formed therein, and a portion of the substrate 14 that corresponds to the pressure chamber 3 is exposed from the opening. The second resist 16 covers the exposed width change portion w1-w1', and an opening edge w2-w2' of the second resist 16 is at a distance K from the exposed width change portion w1-w1'.

Note that, the width D1 and the width C1 of the opening in the first resist 15 and the width D2 of the opening in the second resist 16 are set similarly to the case of the second embodiment.

FIGS. 12A, 13A, 14A, and 15A are plan views and FIGS. 12B, 13B, 14B, and 15B are perspective views for illustrating a manufacturing method according to the third embodiment, in particular, for illustrating steps subsequent to the steps of forming the first resist 15 and the second resist 16. Note that, in FIG. 12A to FIG. 15B, only the communicating portion G (see FIGS. 10A and 10B) is illustrated.

Figure 12A:
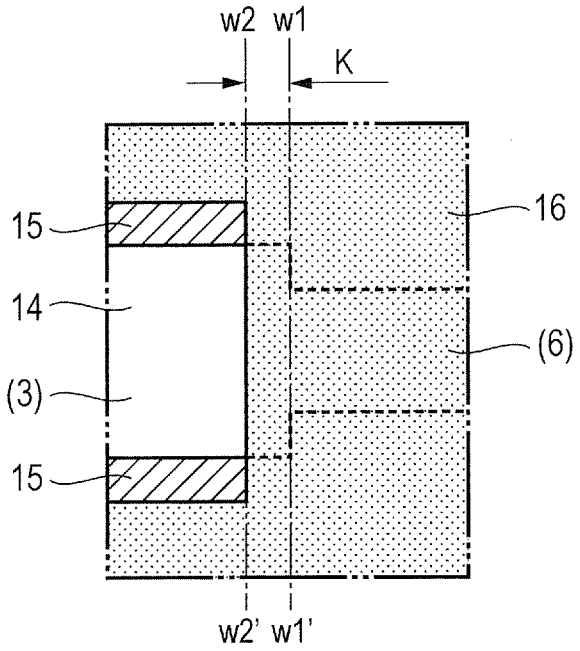
FIGS. 12A and 12B are a plan view and a perspective view, respectively, for illustrating the third embodiment.
Figure 12B:
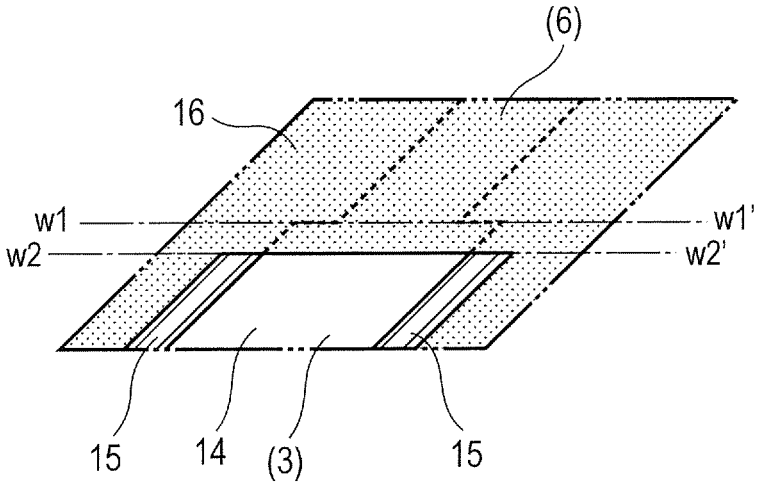

As illustrated in FIGS. 12A and 12B, the first resist 15 and the second resist 16 are formed on the surface of the substrate 14 on the side opposite to the drive layer, using the photolithography. As described above, the second resist 16 covers the exposed width change portion w1-w1', and the opening edge w2-w2' of the second resist 16 is at the distance K from the exposed width change portion w1-w1'.

Figure 13A:
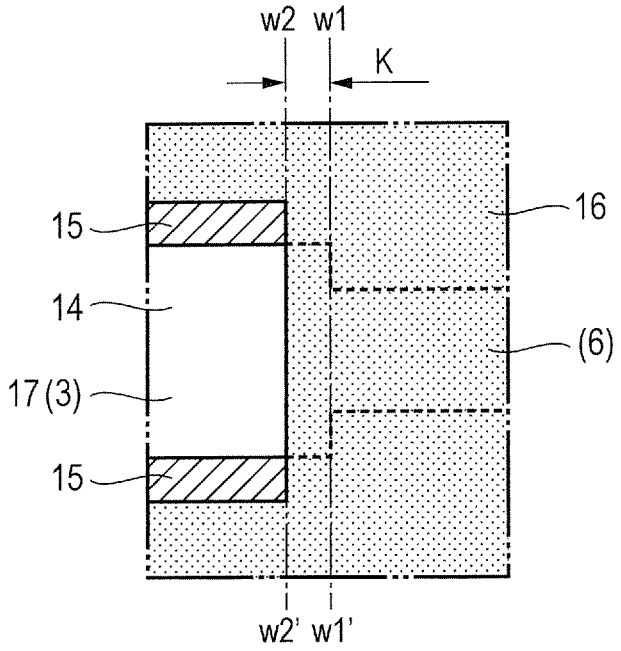
FIGS. 13A and 13B are a plan view and a perspective view, respectively, for illustrating the third embodiment.
Figure 13B:
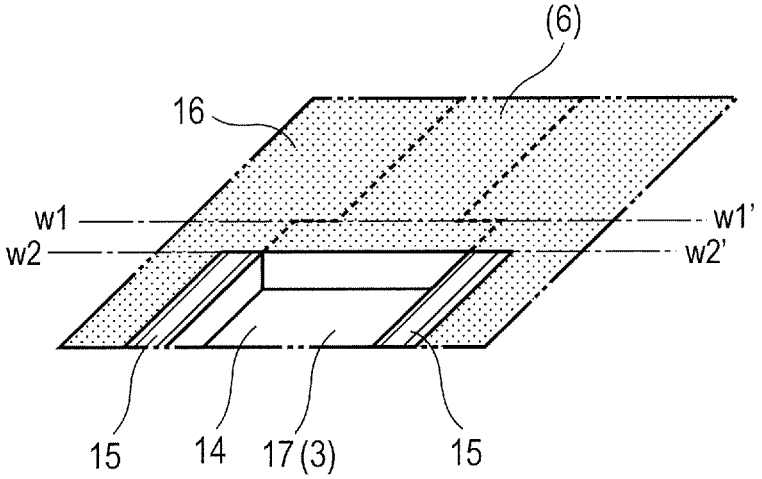

First, as illustrated in FIGS. 13A and 13B, the substrate 14 is dry etched with the first resist 15 and the second resist 16 being used as the mask to form the first recess 17 in the substrate 14 (first etching process). The first recess 17 does not pierce the substrate 14 and is formed to midway through the substrate 14. In this case, the etching progresses along the opening edge w2-w2' of the second resist 16, and a wall of the first recess 17 on the flow reducing portion 6 side is formed along the opening edge w2-w2'.

Figure 14A:
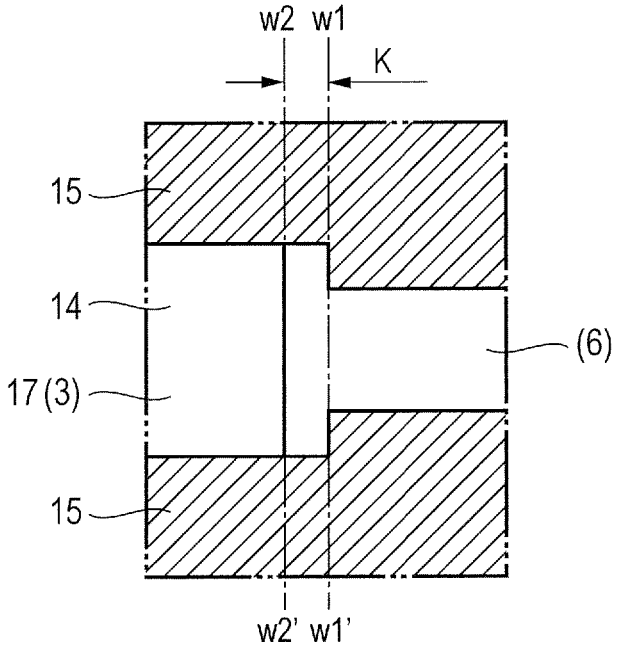
FIGS. 14A and 14B are a plan view and a perspective view, respectively, for illustrating the third embodiment.
Figure 14B:
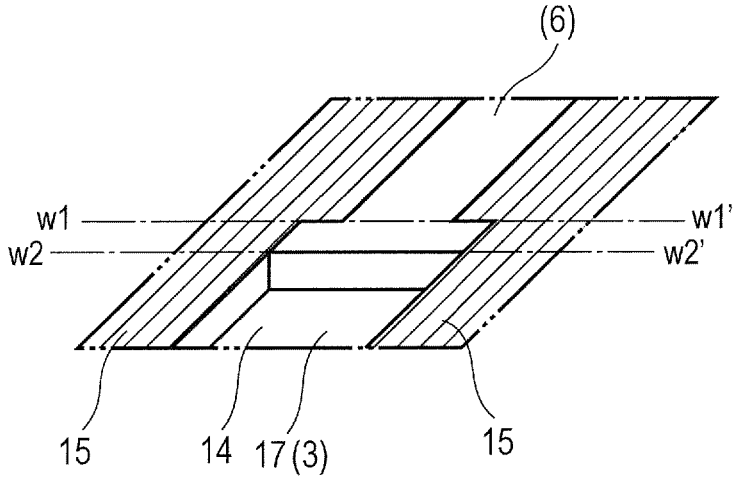

Then, as illustrated in FIGS. 14A and 14B, the second resist 16 is removed with a remover or the like to expose a portion of the substrate 14 that is different from the first recess 17.

Figure 15A:
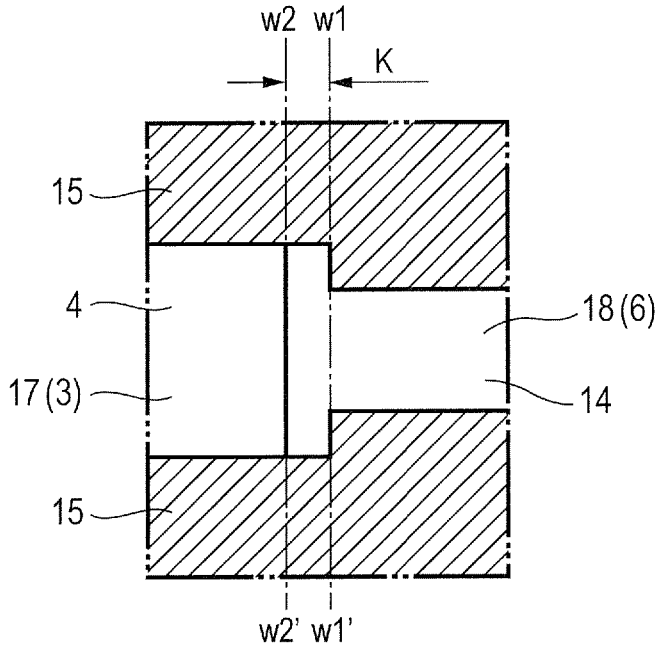
FIGS. 15A and 15B are a plan view and a perspective view, respectively, for illustrating the third embodiment.
Figure 15B:
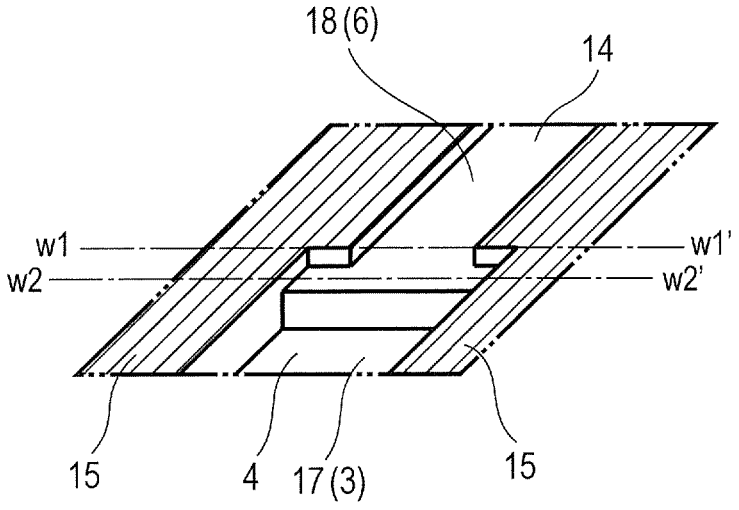

Then, as illustrated in FIGS. 15A and 15B, the substrate 14 is dry etched with the remaining first resist 15 being used as a mask to deepen the first recess 17 and to form the second recess 18 (second etching process). In the portion of the substrate 14 corresponding to the pressure chamber 3, the etching progresses along the opening in the first resist 15, and the first recess 17 becomes deeper with the width D1 being maintained. Also in the portion of the substrate 14 corresponding to the flow reducing portion 6, the etching progresses along the opening in the first resist 15, and the second recess 18 is to have the width C1. The first recess 17 reaches the diaphragm 4. In this way, the flow path forming member 12 (see FIGS. 2A and 2B) formed of the substrate 14 is completed.

Finally, the orifice forming member 11 having the orifice 2 formed therein (see FIG. 2A) is mounted on the substrate 14 (flow path forming member 12) so as to cover the opening of the first recess 17 and the opening of the second recess 18. The pressure chamber 3 is formed by the first recess 17 and the orifice forming member 11, and the flow reducing portion 6 is formed by the second recess 18 and the orifice forming member 11. It is preferred that the orifice forming member 11 be formed so that the orifice 2 and the actuating portion 5 are opposed to each other.

Note that, in this embodiment, the orifice forming member 11 is mounted on the flow path forming member 12 without removing the first resist 15, but the first resist 15 may be removed.

In the third embodiment, a vibrating end of the diaphragm 4 is formed substantially linearly with the opening edge w2-w2' of the second resist 16. Therefore, stress applied to the end of the diaphragm 4 due to vibrations of the diaphragm 4 when driven can be uniformized, and a crack in the diaphragm 4 due to the stress can be prevented. As a result, the diaphragm 4 has improved durability, and the element substrate for carrying out high frequency ejection can be stabilized and can have a longer life.

Note that, the distance K between the opening end w1-w1' of the first resist 15 and the opening edge w2-w2' of the second resist 16 can be appropriately set taking into consideration alignment accuracy and etching accuracy when the first resist 15 and the second resist 16 are formed and the like.

Further, in this embodiment, in order to form the pressure chamber 3 into a substantially rectangular shape in plan view, the opening edge w2-w2' of the second resist 16 is linearly formed. In accordance with the shape of the pressure chamber 3 such as a substantial oval or a substantial ellipsoid, the opening edge w2-w2' of the second resist 16 can be formed to have a curved shape.

Comparative Example

Figure 16A:
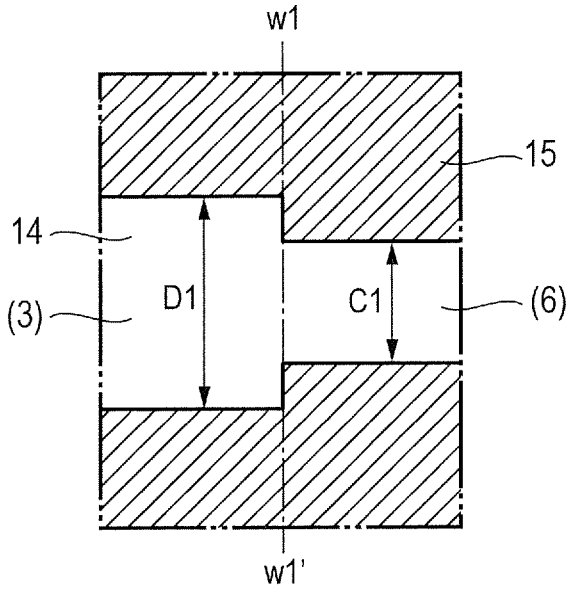
FIGS. 16A and 16B are illustrations of first and second resists in a comparative example of the present invention.
Figure 16B:
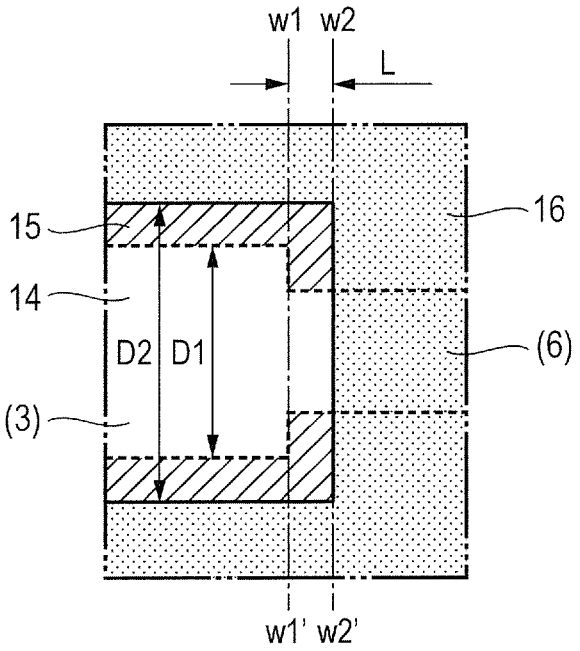

Now, a comparative example of the third embodiment is described with reference to FIG. 16A to FIG. 20B. FIGS. 16A and 16B are illustrations of the first resist 15 and the second resist 16 in the comparative example, and FIGS. 16A, 17A, 18A, 19A, and 20A are plan views of a portion corresponding to the communicating portion G (see FIGS. 10A and 10B) when seen from the direction of the arrow F in FIG. 10A.

Note that, the first resist 15 and the second resist 16 are hatched. Similarly to the enlarged views of FIGS. 11A and 11B, in FIG. 16A, the first resist 15 is illustrated, and, in FIG. 16B, the first resist 15 and the second resist 16 are illustrated. With reference to FIG. 16B, part of the first resist 15 is covered with the second resist 16. In FIG. 16B, for the sake of easy understanding of a positional relationship between the first resist 15 and the second resist 16, edges of the first resist 15 are shown by the broken lines.

As illustrated in FIGS. 16A and 16B, in the comparative example, contrary to the case of the third embodiment, the second resist 16 does not cover the exposed width change portion w1-w1'. The opening edge w2-w2' of the second resist 16 is at a distance L from the exposed width change portion w1-w1' of the first resist 15. Therefore, the pressure chamber 3 includes a portion having the width D1 and a portion having the width C1.

FIGS. 17A, 18A, 19A, and 20A are plan views and FIGS. 17B, 18B, 19B, and 20B are perspective views for illustrating a manufacturing method according to the comparative example, in particular, for illustrating steps subsequent to the steps of forming the first resist 15 and the second resist 16. Note that, in FIG. 17A to FIG. 20B, only the communicating portion G is illustrated.

Figure 17A:
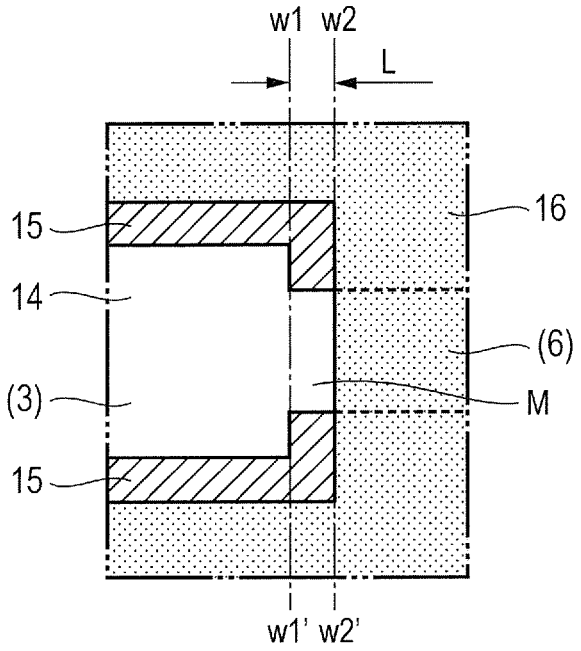
FIGS. 17A and 17B are a plan view and a perspective view, respectively, for illustrating the comparative example.
Figure 17B:
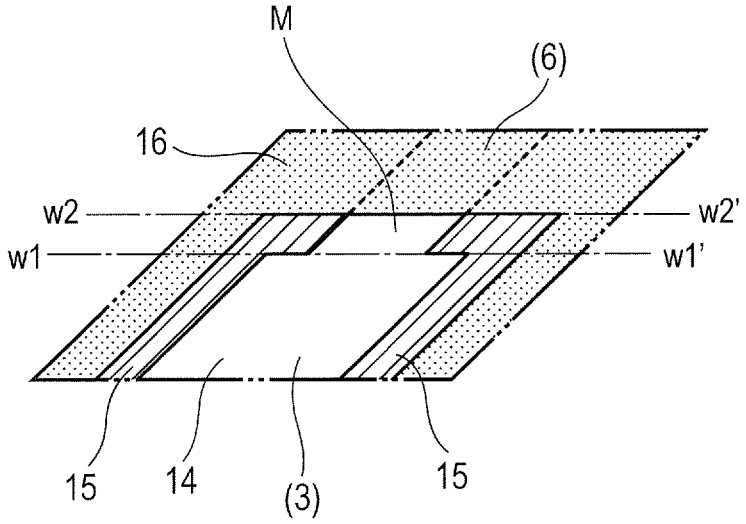

As illustrated in FIGS. 17A and 17B, the first resist 15 and the second resist 16 are formed on the surface of the substrate 14 on the side opposite to the drive layer, using the photolithography. As described above, the second resist 16 does not cover the exposed width change portion w1-w1', and the opening edge w2-w2' of the second resist 16 is at the distance L from the exposed width change portion w1-w1' of the first resist 15.

Figure 18A:
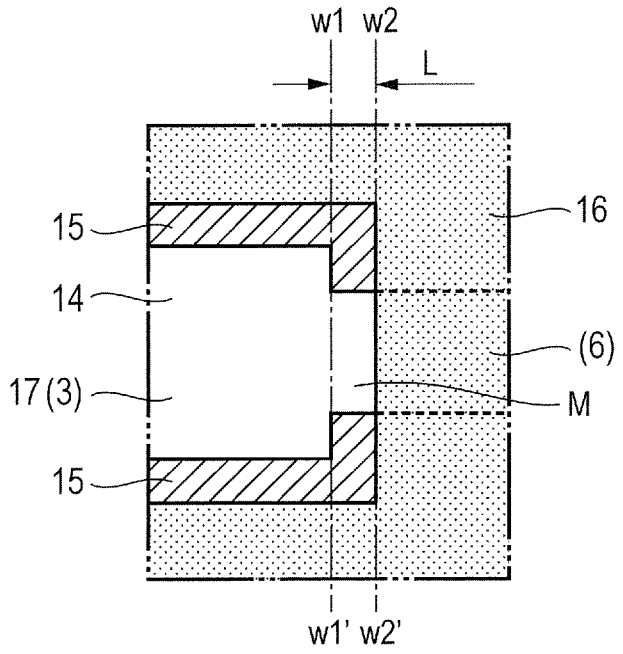
FIGS. 18A and 18B are a plan view and a perspective view, respectively, for illustrating the comparative example.
Figure 18B:
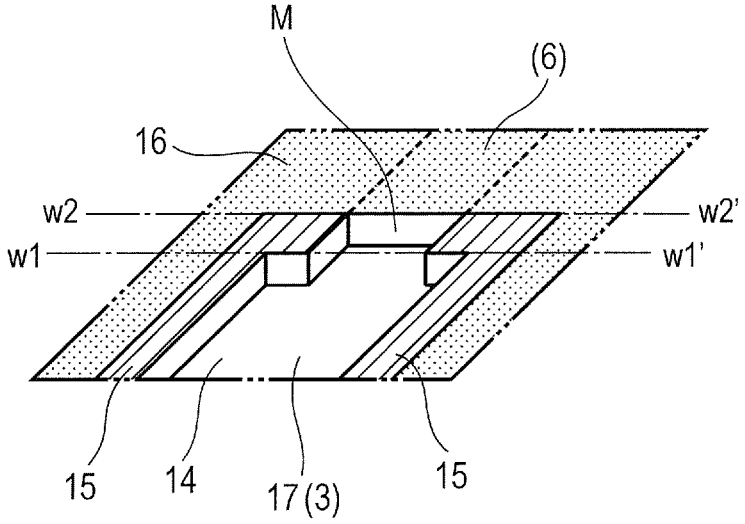

First, as illustrated in FIGS. 18A and 18B, the substrate 14 is dry etched with the first resist 15 and the second resist 16 being used as the mask to form the first recess 17 in the substrate 14 (first etching process). The first recess 17 does not pierce the substrate 14 and is formed to midway through the substrate 14.

In this case, the etching progresses along the opening edge w2-w2' of the second resist 16, and a wall of the first recess 17 on the flow reducing portion 6 side is formed along the opening edge w2-w2'. Therefore, the first recess 17 includes a portion having the width D1 and a portion M having the width C1.

Figure 19A:
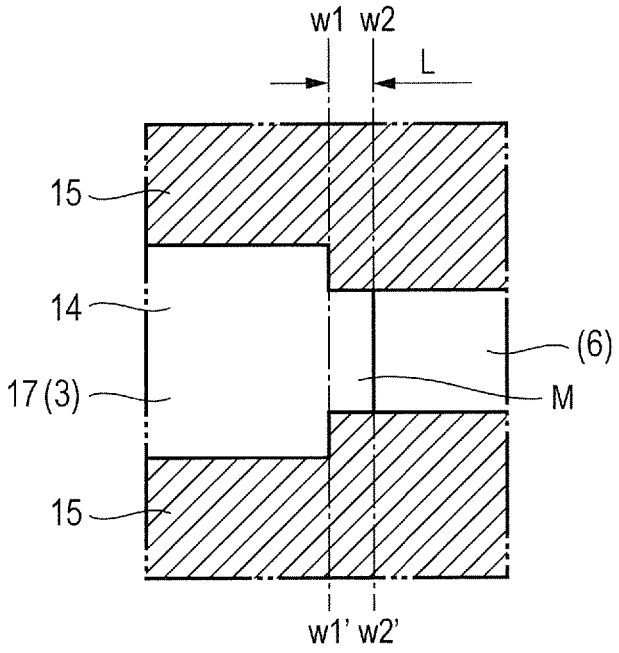
FIGS. 19A and 19B are a plan view and a perspective view, respectively, for illustrating the comparative example.
Figure 19B:
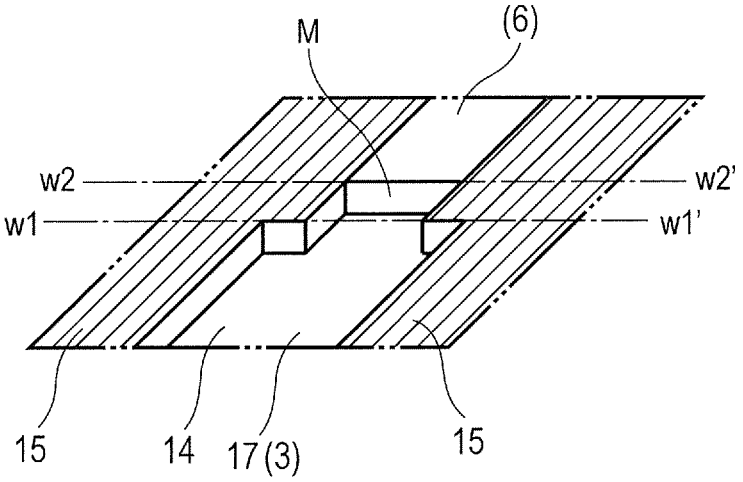

Then, as illustrated in FIGS. 19A and 19B, the second resist 16 is removed with a remover or the like to expose a portion of the substrate 14 that is different from the first recess 17.

Figure 20A:
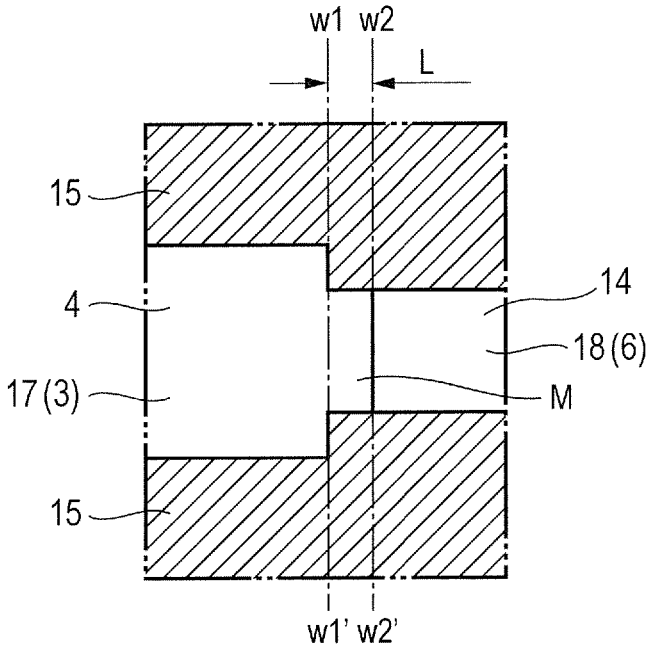
FIGS. 20A and 20B are a plan view and a perspective view, respectively, for illustrating the comparative example.
Figure 20B:
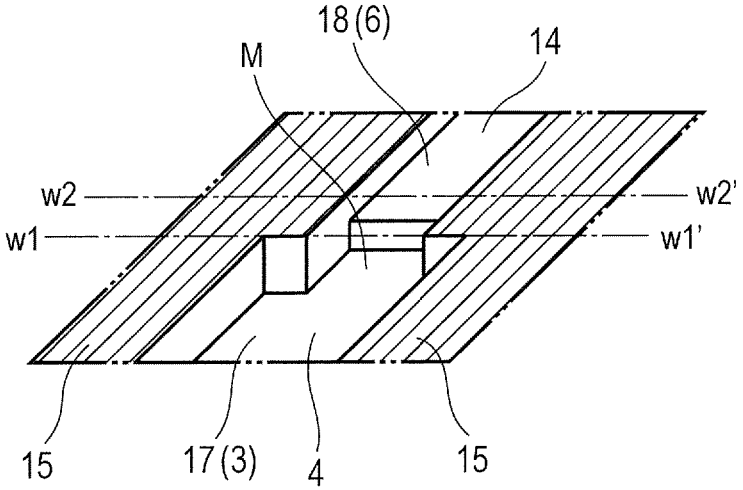

Then, as illustrated in FIGS. 20A and 20B, the substrate 14 is dry etched with the remaining first resist 15 being used as a mask to deepen the first recess 17 and to form the second recess 18 (second etching process). In the portion of the substrate 14 corresponding to the pressure chamber 3, the etching progresses along the opening in the first resist 15. Therefore, the first recess 17 includes the portion having the width D1 and the portion M having the width C1. In the portion of the substrate 14 corresponding to the flow reducing portion 6, the etching progresses along the opening in the first resist 15, and the second recess 18 is in a shape having the width C1. The first recess 17 reaches the diaphragm 4. In this way, the flow path forming member 12 (see FIGS. 2A and 2B) formed of the substrate 14 is completed.

Finally, the orifice forming member 11 having the orifice 2 formed therein (see FIG. 2A) is mounted on the substrate 14 (flow path forming member 12) so as to cover the opening of the first recess 17 and the opening of the second recess 18. The pressure chamber 3 is formed by the first recess 17 and the orifice forming member 11, and the flow reducing portion 6 is formed by the second recess 18 and the orifice forming member 11.

In the comparative example, the pressure chamber includes the portion M having the width C1, and the vibrating end of the diaphragm 4 is in a shape having a protruding portion. When the diaphragm 4 has such a protruding portion, due to the protruding portion distorted by vibrations of the diaphragm 4, a crack may develop in the diaphragm 4 by a stress. In particular, in an element substrate for carrying out high frequency ejection with high ejecting power, a crack is more liable to develop in the protruding portion of the diaphragm 4, which may reduce durability thereof.

Fourth Embodiment

Figure 21:
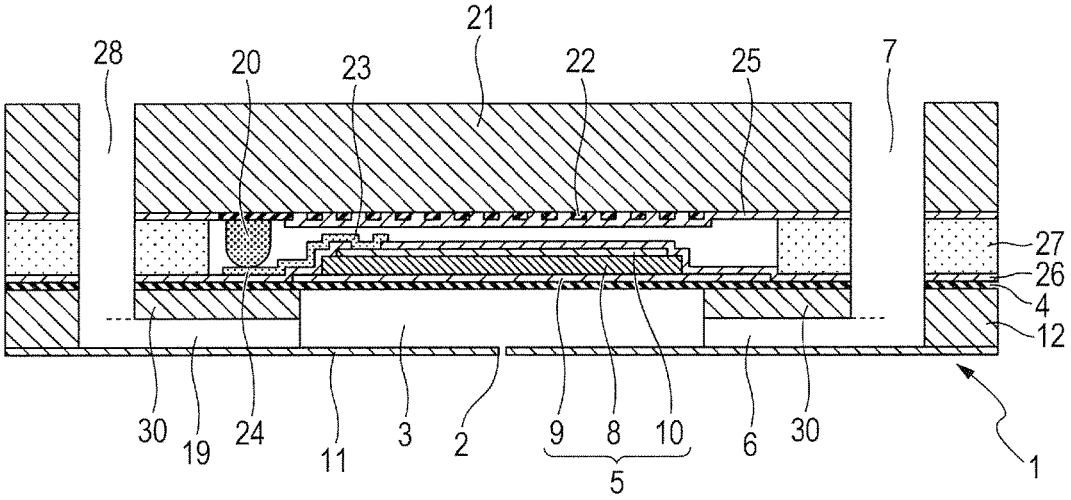
FIG. 21 is a sectional view of a liquid ejection head including the element substrate.

Next, a fourth embodiment of the present invention is described with reference to FIG. 21 to FIG. 24H. FIG. 21 is a sectional view of a liquid ejection head including the element substrate 1 that is manufactured using a manufacturing method according to the fourth embodiment.

As illustrated in FIG. 21, the element substrate 1 includes the pressure chambers 3, the orifices 2 formed correspondingly to the respective pressure chambers 3, the diaphragms 4 that form walls of the pressure chambers 3, and a plurality of flow reducing portions 6 and 19 formed for each of the pressure chambers 3. The actuating portion 5 is joined to the diaphragm 4. Actuation of the actuating portion 5 deforms the diaphragm 4 to apply a pressure to the liquid in the pressure chamber 3. The liquid is supplied from the flow reducing portion 6 to the pressure chamber 3, and is recovered from the pressure chamber 3 via the flow reducing portion 19. Note that, the flow reducing portion 6 is also referred to as a flow reducing portion for supplying the liquid, and the flow reducing portion 19 is also referred to as a flow reducing portion for recovering the liquid.

The actuating portion 5 includes the piezoelectric element 8, and the first electrode 9 and the second electrode 10 opposed to each other with the piezoelectric element 8 sandwiched therebetween. The first electrode 9 is joined to the diaphragm 4. The first electrode 9 and the second electrode 10 are electrically connected to wiring 22 of a wiring substrate 21 via a bump 20, and are led out to a control circuit outside the element substrate 1 via the wiring 22.

More specifically, the second electrode 10 is electrically led out via lead out wiring 23 to be connected to the bump 20 via a bump pad 24. The first electrode 9 extends under the piezoelectric element 8 that corresponds to each of the pressure chambers 3, and the first electrodes 9 are collectively connected through the bump 20 at an end portion of the element substrate 1. As the bump 20, for example, a Au bump can be used. The wiring 22 may be protected by a protective film 25. The actuating portion 5 may be protected by a protective film 26. A structure 27 may be arranged between the element substrate 1 and the wiring substrate 21.

When an electrical signal from the control circuit is applied to the piezoelectric element 8 through the wiring substrate 21, the diaphragm 4 is deformed, and the pressure chamber 3 contracts and expands. The contraction of the pressure chamber 3 applies a pressure to the liquid in the pressure chamber 3, and the liquid can be ejected through the orifice 2 due to the pressure. The flow reducing portion 6 on the liquid supply side and the flow reducing portion 19 on the liquid recovery side have larger inertia than that of the orifice 2 so that the pressure generated in the pressure chamber 3 is applied to the orifice 2.

The wiring substrate 21 is joined to a plurality of element substrates 1 that are two-dimensionally arranged, and also has the function of maintaining solidity of the plurality of element substrates 1. Further, the wiring substrate 21 has, formed therein, the communicating hole 7 on the supply side that communicates with the flow reducing portion 6 and a communicating hole 28 on the recovery side that communicates with the flow reducing portion 19. The liquid is supplied from the flow reducing portion 6 to the pressure chamber 3, and is recovered from the flow reducing portion 19 via the pressure chamber 3. In this way, the element substrate 1 forms part of a circulation flow. In other words, the wiring substrate 21 has the function of supplying the liquid to the element substrate 1 and recovering the liquid from the element substrate 1, the function of arranging and supporting the element substrates 1, and the function of applying an electrical control signal to a liquid ejecting portion.

A method of manufacturing the element substrate 1 illustrated in FIG. 21 is described with reference to FIG. 22A to FIG. 24H. FIGS. 22A to 22K are illustrations of a method of forming the diaphragm 4, the actuating portion 5, the protective film 26, and the structure 27.

Figure 22A:
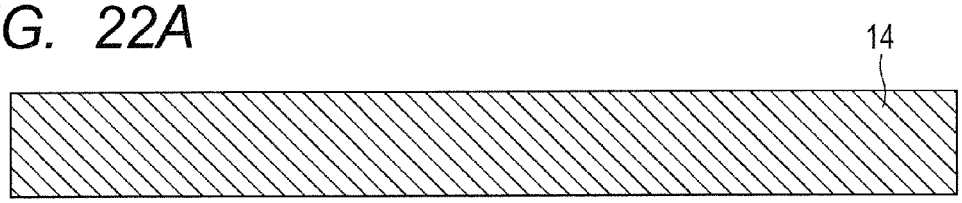
FIGS. 22A, 22B, 22C, 22D, 22E, 22F, 22G, 22H, 22I, 22J and 22K are sectional views for illustrating a fourth embodiment of the present invention.
Figure 22B:
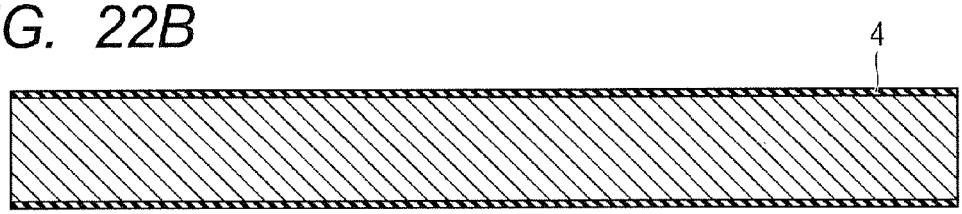
Figure 22C:
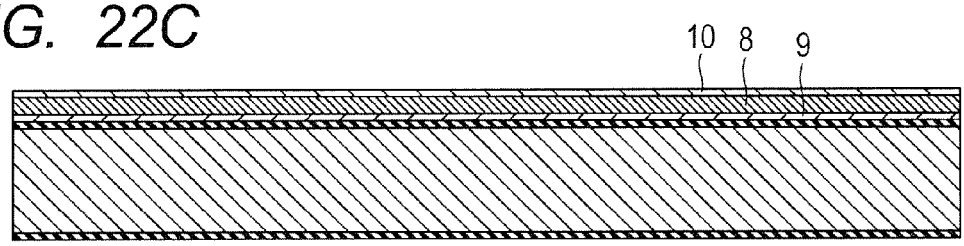
Figure 22D:
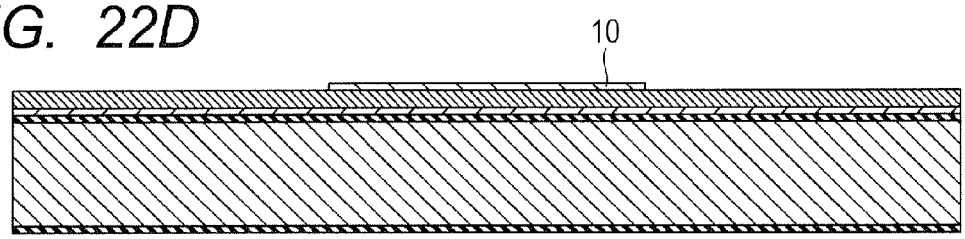
Figure 22E:
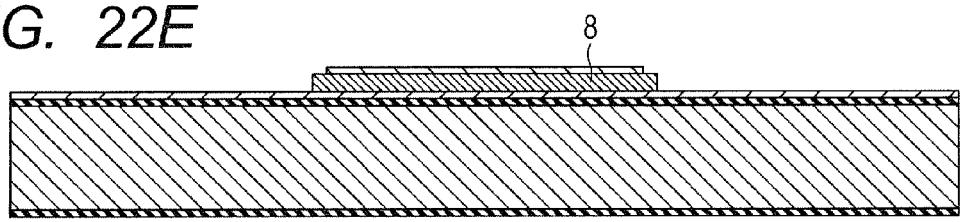
Figure 22F:
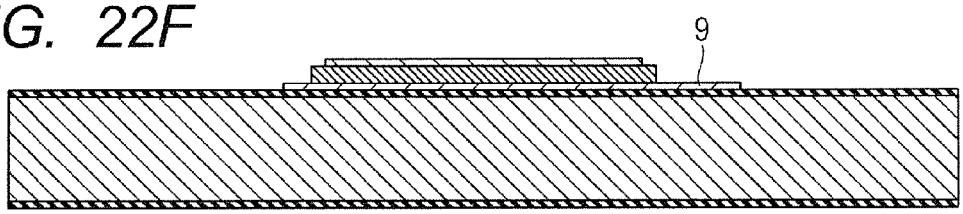
Figure 22G:
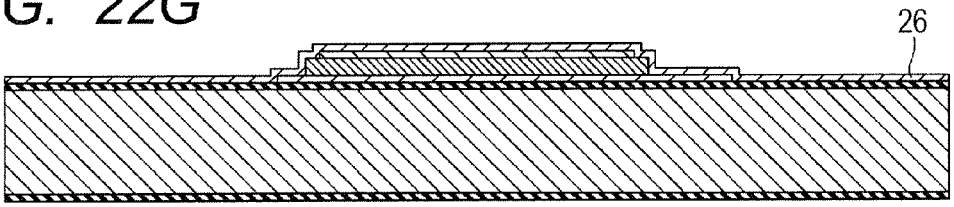
Figure 22H:
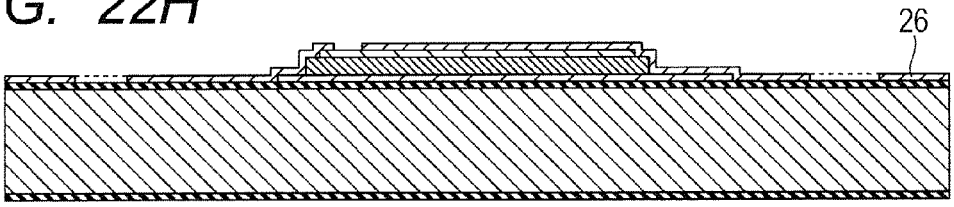

First, the substrate 14 formed of silicon is prepared (FIG. 22A). A silicon oxide film serving as the diaphragm 4 is formed on the substrate 14 (FIG. 22B), and the first electrode 9, the piezoelectric element 8, and the second electrode 10 are formed (FIG. 22C). Then, through etching, the second electrode 10 is patterned (FIG. 22D), the piezoelectric element 8 is patterned (FIG. 22E), and the first electrode 9 is patterned (FIG. 22F), and the protective film 26 is formed (FIG. 22G).

Figure 22I:
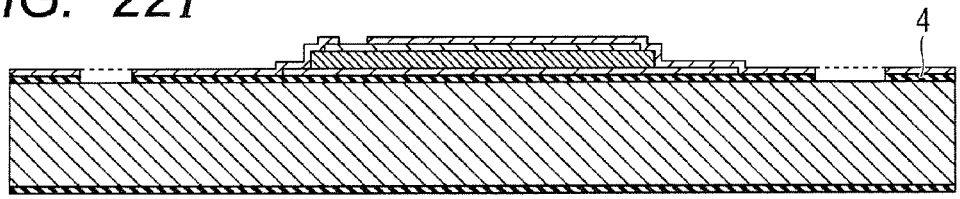
Figure 22J:
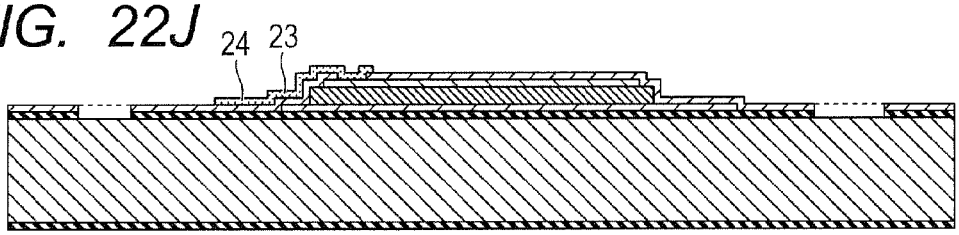
Figure 22K:
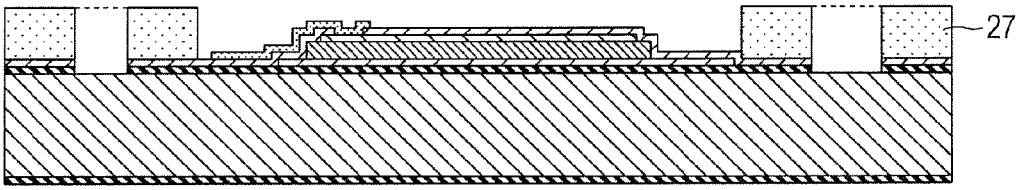

After that, the protective film 26 is patterned (FIG. 22H), and the silicon oxide film forming the diaphragm 4 is patterned (FIG. 22I). The lead out wiring and the bump pad 24 are formed (FIG. 22J), and a photosensitive resin is patterned to form the structure 27 (FIG. 22K).

Figure 23A:
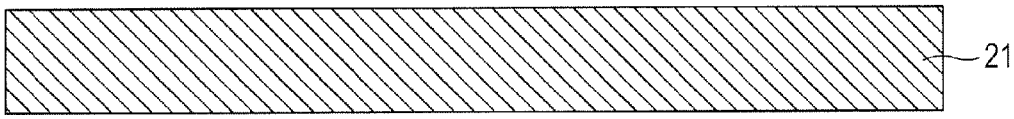
FIGS. 23A, 23B, 23C, 23D, 23E, 23F, 23G, 23H, 23I and 23J are sectional views for illustrating the fourth embodiment.
Figure 23B:
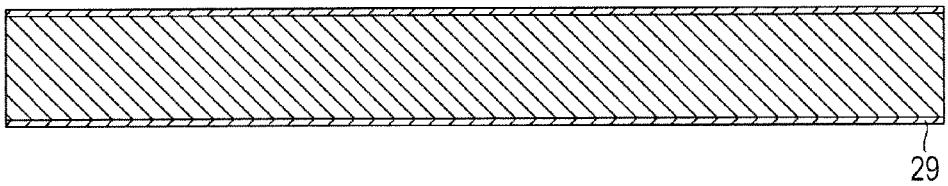
Figure 23C:
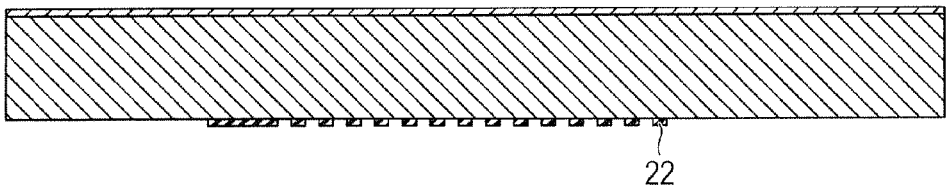
Figure 23D:
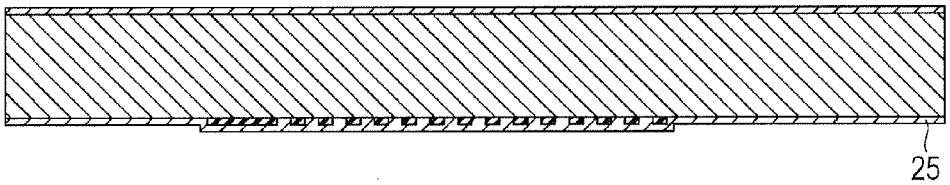

FIGS. 23A to 23J are illustrations of a method of forming the wiring 22, the protective film 25, the communicating holes 7 and 28, and the bump 20 on the wiring substrate 21. First, the wiring substrate 21 formed of silicon is prepared (FIG. 23A). A silicon oxide film 29 is formed on the wiring substrate 21 (FIG. 23B), the wiring 22 is patterned (FIG. 23C), and the protective film 25 is formed (FIG. 23D).

Figure 23E:
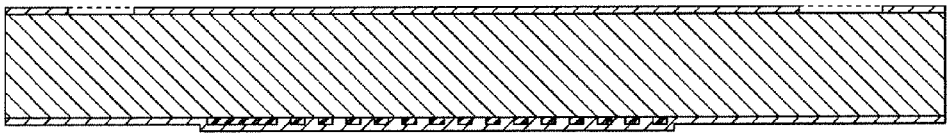
Figure 23F:
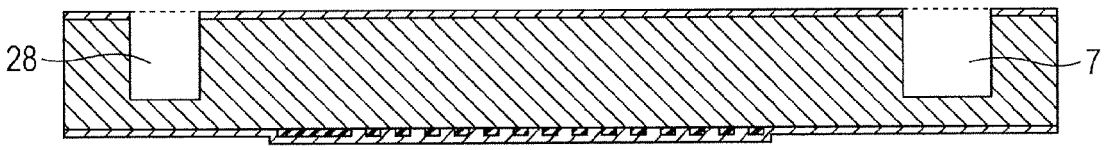
Figure 23G:
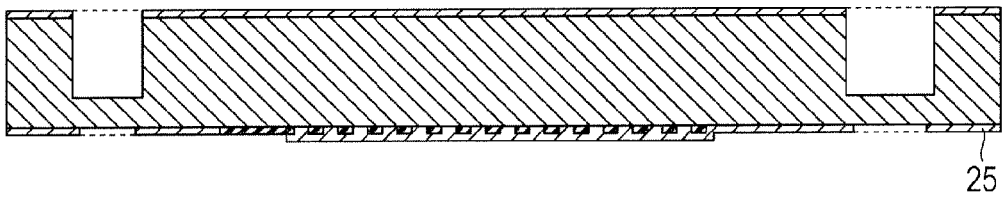
Figure 23H:
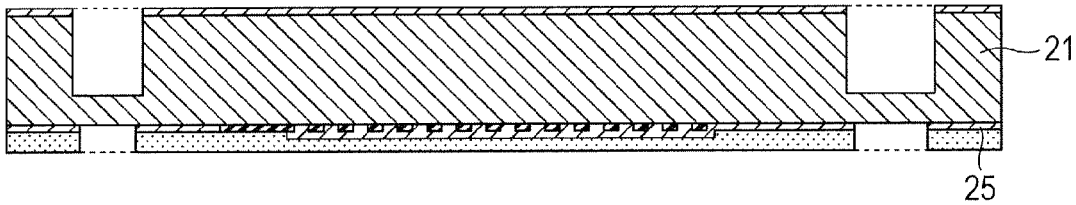
Figure 23I:
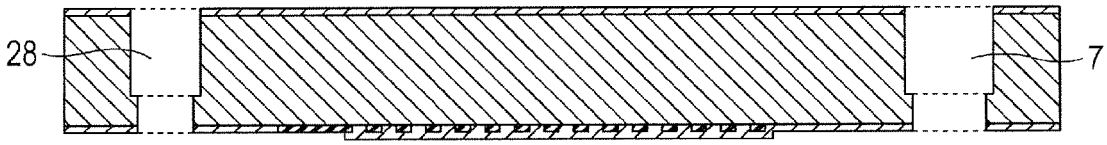
Figure 23J:
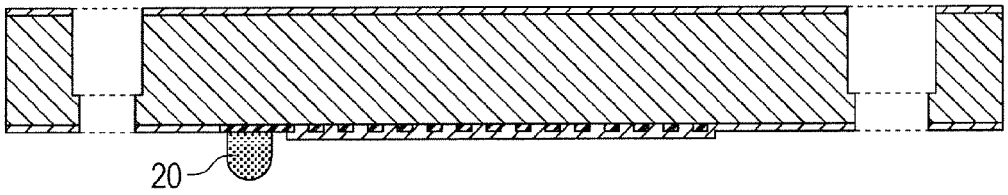

The silicon oxide film 29 on the surface of the wiring substrate 21 on the side opposite to the surface on which the wiring 22 is formed is patterned (FIG. 23E). The communicating hole 7 on the supply side and the communicating hole 28 on the recovery side are etched by deep-RIE to midway through the wiring substrate 21 with the silicon oxide film 29 being used as a mask (FIG. 23F), and the protective film 25 is patterned (FIG. 23G). The wiring substrate 21 is etched from the side on which the protective film 25 is formed (FIG. 23H) to cause the communicating hole 7 to be a through hole and to cause the communicating hole 28 to be a through hole (FIG. 23I). After that, the bump 20 is formed (FIG. 23J).

Figure 24A:
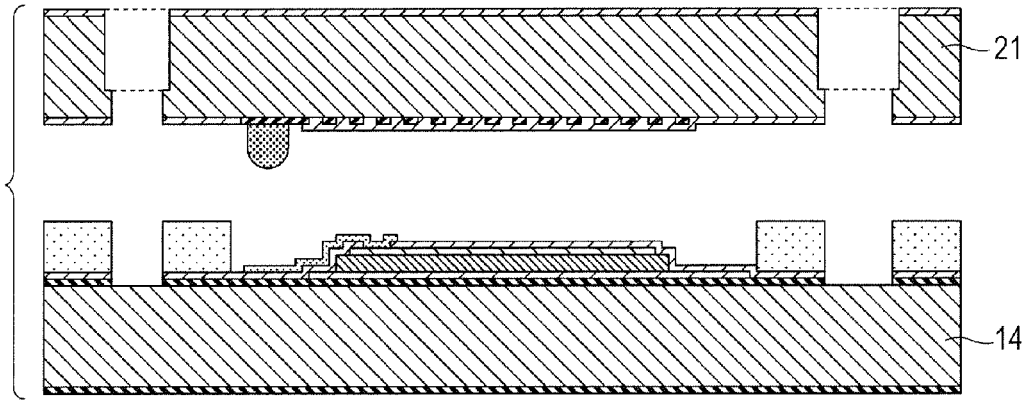
FIGS. 24A, 24B, 24C, 24D, 24E, 24F, 24G and 24H are sectional views for illustrating the fourth embodiment.
Figure 24B:
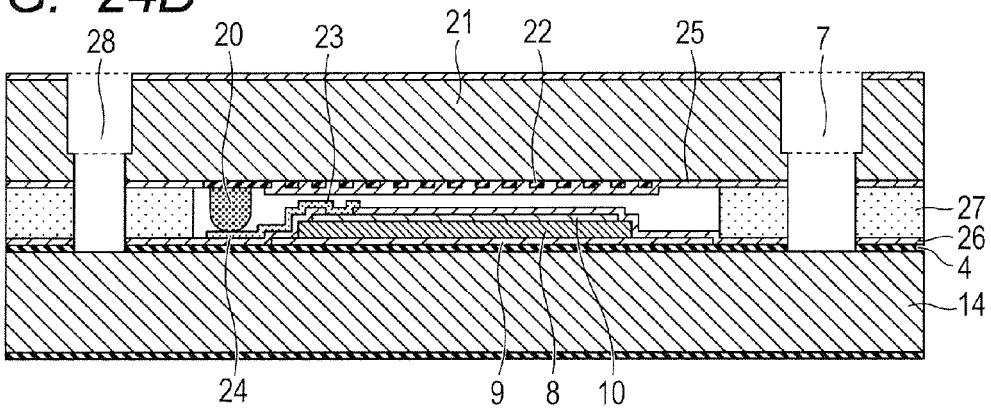

FIGS. 24A to 24H are illustrations of a method of joining together the substrate 14 having the diaphragm 4, the actuating portion 5, the protective film 26, and the structure 27 formed thereon and the wiring substrate 21 having the wiring 22, the protective film 25, the communicating holes 7 and 28, and the bump 20 formed thereon to form the pressure chamber 3. First, the substrate 14 and the wiring substrate 21 that are manufactured using the methods described with reference to FIGS. 22A to 22K and FIGS. 23A to 23J, respectively, are prepared (FIG. 24A). The substrate 14 and the wiring substrate 21 are electrically connected to each other via the bump 20, and at the same time, photosensitive film joining is carried out (FIG. 24B).

Figure 24C:
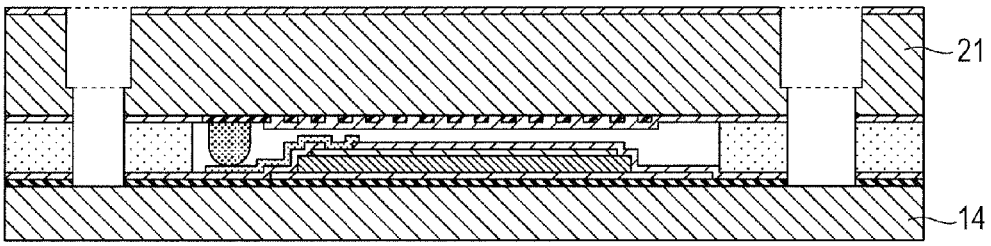
Figure 24D:
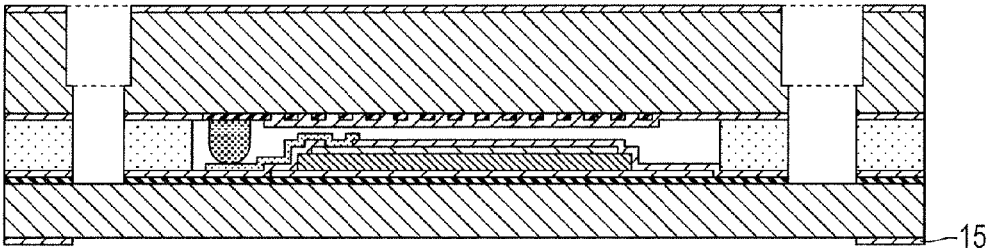
Figure 24E:
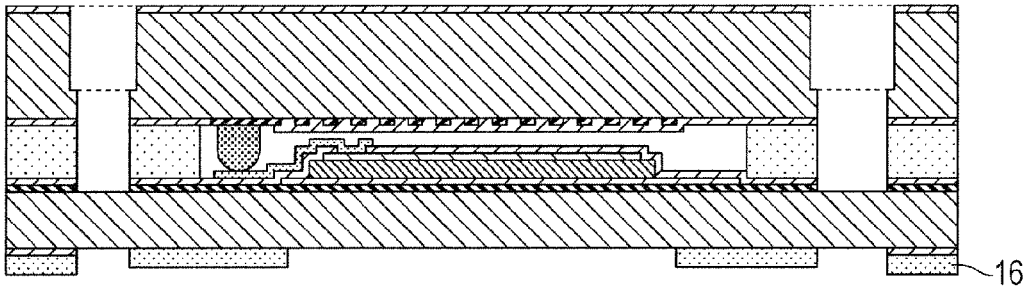

Then, the surface of the substrate 14 on the side opposite to the wiring substrate 21 side is ground to a desired thickness (FIG. 24C). After that, the first resist 15 is formed (FIG. 24D), and the second resist 16 is formed (FIG. 24E). At this time, similarly to the case of the third embodiment, the openings are formed in the first resist 15 and the second resist 16 so that the opening edge of the second resist 16 is located on the pressure chamber side with respect to the exposed width change portion of the first resist 15.

Figure 24F:
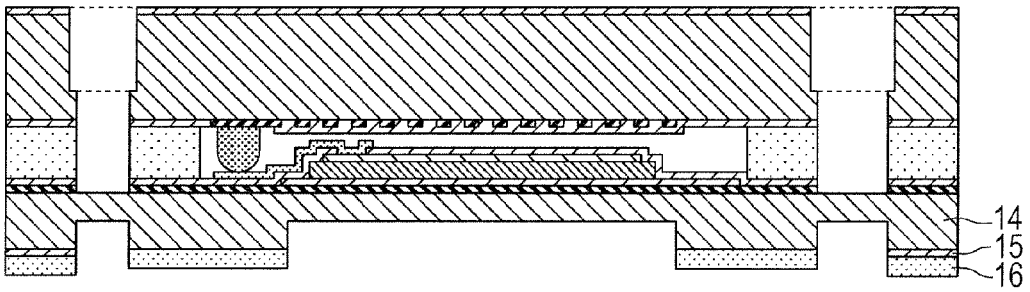
Figure 24G:
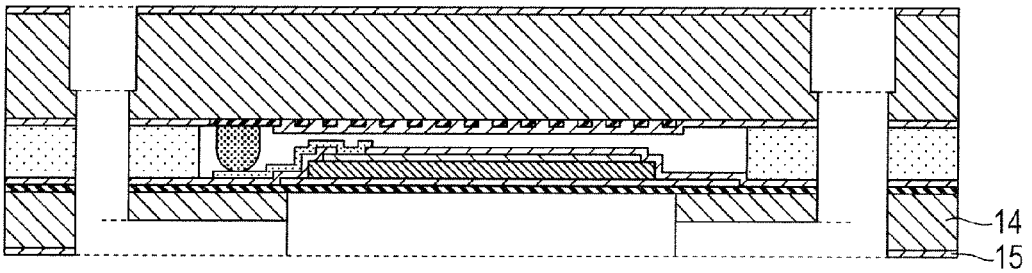

Then, the substrate 14 is etched with the first resist 15 and the second resist 16 being used as the mask (FIG. 24F). After that, the second resist 16 is removed, and the substrate 14 is further etched with the remaining first resist 15 being used as the mask (FIG. 24G). A hole that reaches the diaphragm 4 is formed in the substrate 14, and the flow path forming member 12 (see FIGS. 2A and 2B) formed of the substrate 14 is completed.

Figure 24H:
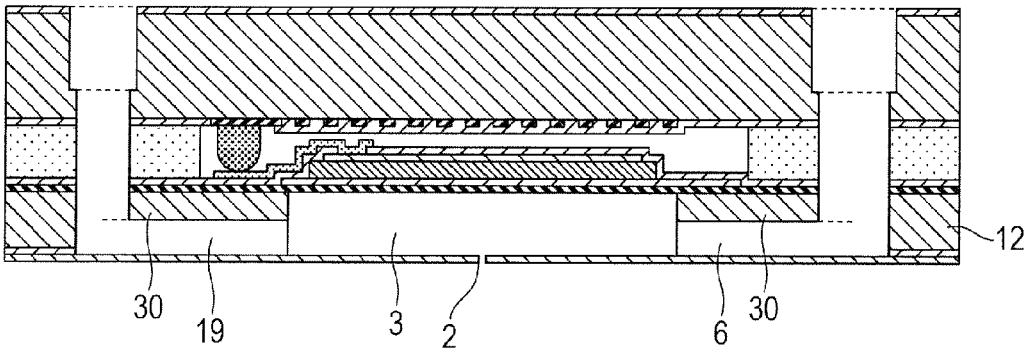

Finally, the orifice forming member 11 having the orifice 2 formed therein is mounted on the flow path forming member 12 (FIG. 24H). The pressure chamber 3, the flow reducing portion 6, and the flow reducing portion 19 are formed by the flow path forming member 12 and the orifice forming member 11, and the element substrate 1 is completed.

When the element substrate 1 forms part of the circulation flow of the liquid, it is necessary to more strictly control a relationship of the flow path resistance among the orifice 2, the pressure chamber 3, the flow reducing portion 6 on the supply side, and the flow reducing portion 19 on the recovery side compared with a case of a system in which no circulation flow is formed. Therefore, it is required to further reduce variations in processing the pressure chamber 3, the flow reducing portion 6 on the supply side, and the flow reducing portion 19 on the recovery side.

In the fourth embodiment, the flow reducing portions 6 and 19 can be shallower than the pressure chamber 3, and thus, the flow path widths of the flow reducing portions 6 and 19 can be increased. Therefore, variations in processing the pressure chamber 3, the flow reducing portion 6, and the flow reducing portion 19 can be further reduced, and the element substrate that forms part of the circulation flow of the liquid can be manufactured with a high yield.

Further, part of the flow path forming member 12 (hereinafter referred to as "structure 30") is formed in each of the flow reducing portion 6 and the flow reducing portion 19 on the diaphragm 4 side, and thus, there is an effect that deformation of the diaphragm 4 due to swelling of the photosensitive resin forming the structure 27 in contact with the liquid is inhibited. The formation of the structure 30 has a further effect that change in cross-sectional areas of the flow reducing portion 6 on the supply side and of the flow reducing portion 19 on the recovery side due to deformation of the diaphragm 4 and breakage of the diaphragm 4 are prevented.

The present invention is described above with reference to the embodiments and the examples, but the present invention is not limited to the above-mentioned embodiments and examples. Various changes that may be understood by those who skilled in the art may be made to the present invention.

As described above, according to the present invention, it is possible to manufacture the element substrate that can render an image at a high speed with a high yield.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-175518, filed Aug. 29, 2014, which is hereby incorporated by reference herein in its entirety.

What is claimed is:

1. A method of manufacturing an element substrate, the element substrate comprising:

an orifice forming member having an orifice for ejecting liquid formed therein; and a flow path forming member for forming a pressure chamber for storing the liquid to be ejected through the orifice and for generating an ejection pressure, and forming a flow reducing portion communicating with the pressure chamber, the method comprising:

forming a first resist and a second resist on a first surface of a substrate serving as the flow path forming member so that part of the first surface is exposed;

etching the substrate from a side of the first surface toward a side of a second surface of the substrate, which is a surface opposite to the first surface, with the first resist and the second resist being used as a mask to form a first recess in the substrate;

removing the second resist to expose a portion of the substrate that is different from the first recess;

etching the substrate from the side of the first surface to the side of the second surface with the first resist being used as a mask to deepen the first recess and to form a second recess communicating with the first recess on the side of the second surface; and covering openings of the first recess and the second recess with the orifice forming member to form the pressure chamber by the first recess and the orifice forming member and to form the flow reducing portion on the side of the second surface by the second recess and the orifice forming member.

2. The method according to claim 1, further comprising:

forming an opening in the first resist; and using the opening to determine a flow path width of the pressure chamber and a flow path width of the flow reducing portion.

3. The method according to claim 1, further comprising:

forming a plurality of the flow reducing portions for one pressure chamber; and using part of the plurality of the flow reducing portions as a flow reducing portion for supplying the liquid and another part of the plurality of the flow reducing portions as a flow reducing portion for recovering the liquid.

4. The method according to claim 1, further comprising forming a diaphragm, a first electrode, a piezoelectric element, and a second electrode in this order on the second surface, wherein the diaphragm serves as part of a wall of the pressure chamber.

5. The method according to claim 4, further comprising:

forming an exposed width change portion in the first resist; and forming the second resist so as to cover the exposed width change portion.

6. The method according to claim 4, further comprising forming the substrate, the diaphragm, the piezoelectric element, the first electrode, and the second electrode by a silicon monocrystalline substrate.

7. The method according to claim 1, wherein at least one of the first resist and the second resist comprises an inorganic thin film.

8. The method according to claim 7, wherein the inorganic thin film comprises at least one of a silicon oxide film, a silicon nitride film, and a metal film.

9. The method according to claim 1, wherein at least one of the first resist and the second resist comprises an organic thin film.

10. The method according to claim 9, wherein the organic thin film comprises a photosensitive resin film.

11. The method according to claim 1, wherein the formation of the first recess in the substrate comprises dry etching the substrate.

12. The method according to claim 1, wherein the deepening of the first recess and the formation of the second recess in the substrate comprise dry etching the substrate.

* * * * *